US011236570B2

(12) United States Patent
Nguyen et al.

(10) Patent No.: US 11,236,570 B2
(45) Date of Patent: Feb. 1, 2022

(54) RUNNING TOOL AND CONTROL LINE SYSTEMS AND METHODS

(71) Applicant: Cameron International Corporation, Houston, TX (US)

(72) Inventors: Dennis P Nguyen, Pearland, TX (US); Stuart Robinson, Katy, TX (US); Jose Navar, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/487,422

(22) PCT Filed: Feb. 21, 2018

(86) PCT No.: PCT/US2018/018868
§ 371 (c)(1),
(2) Date: Aug. 20, 2019

(87) PCT Pub. No.: WO2018/156526
PCT Pub. Date: Aug. 30, 2018

(65) Prior Publication Data

US 2020/0063516 A1 Feb. 27, 2020

Related U.S. Application Data

(60) Provisional application No. 62/462,716, filed on Feb. 23, 2017, provisional application No. 62/462,775, filed on Feb. 23, 2017.

(51) Int. Cl.
*E21B 33/04* (2006.01)

(52) U.S. Cl.
CPC ..... *E21B 33/04* (2013.01)

(58) Field of Classification Search
CPC .... E21B 33/03; E21B 33/038; E21B 33/0387; E21B 33/035; E21B 33/04
See application file for complete search history.

(56) References Cited

U.S. PATENT DOCUMENTS 4,080,025 A * 3/1978 Garnier ..... E21B 33/038 439/191
4,611,831 A * 9/1986 Truchet ..... F16L 37/56 285/26

(Continued)

FOREIGN PATENT DOCUMENTS

WO 2005/031205 A2 4/2005

OTHER PUBLICATIONS

International Preliminary Report on Patentability for International patent application PCT/US2018/018868 dated Sep. 6, 2019.

(Continued)

*Primary Examiner* — Cathleen R Hutchins
(74) *Attorney, Agent, or Firm* — Helene Raybaud

(57) ABSTRACT

A control line assembly for coupling with a tubing or casing hanger of a wellhead assembly includes a support ring configured to couple with the tubing or casing hanger, and a tubular member configured to extend through a first bore disposed in the support ring, wherein a first end of the tubular member is configured to be stabbed into a passage disposed in a wellhead component of the wellhead assembly, and a second end of the tubular member is configured to be stabbed into a first receptacle disposed in the tubing or casing hanger, wherein, when the control line assembly is coupled with the tubing or casing hanger and the wellhead component is landed over the tubing or casing hanger, a passage disposed in the tubular member is configured to provide communication between the passage of the wellhead component and the first receptacle of the tubing or casing hanger.

17 Claims, 25 Drawing Sheets

(56) References Cited

U.S. PATENT DOCUMENTS

| | | | | |
|---|---|---|---|---|
| 4,615,544 | A * | 10/1986 | Baugh | E21B 33/043 285/18 |
| 2009/0056950 | A1* | 3/2009 | Nicholson | C08K 3/015 166/338 |
| 2011/0247799 | A1 | 10/2011 | June et al. | |
| 2012/0175123 | A1* | 7/2012 | Roberts | H02G 9/02 166/340 |
| 2015/0252635 | A1 | 9/2015 | Hartley et al. | |
| 2016/0060991 | A1 | 3/2016 | Nguyen | |
| 2016/0177652 | A1 | 6/2016 | Thornburrow | |

OTHER PUBLICATIONS

International Search Report and Written Opinion for International patent application PCT/US2018/018868 dated May 30, 2018.

* cited by examiner

RUNNING TOOL AND CONTROL LINE SYSTEMS AND METHODS

CROSS-REFERENCE TO RELATED APPLICATIONS

This application is a 35 U.S.C. § 371 National Phase of International Patent Application No. PCT/US2018/018868, filed Feb. 21, 2018, which claims benefit of U.S. provisional patent application Ser. No. 62/462,716 filed Feb. 23, 2017, and entitled "Control Line Systems and Methods," and U.S. provisional patent application Ser. No. 62/462,775 filed Feb. 23, 2017, and entitled "Running Tool and Control Line Systems and Methods," the entire disclosures of which are hereby incorporated herein by reference in their entirety.

STATEMENT REGARDING FEDERALLY SPONSORED RESEARCH OR DEVELOPMENT

Not applicable.

BACKGROUND

Hydrocarbon well systems require various components to access and extract hydrocarbons from subterranean earthen formations. Such systems may include a wellhead assembly through which the hydrocarbons, such as oil and natural gas, are extracted. The wellhead assembly may include a variety of components, such as valves, fluid conduits, controls, casings, hangers, and the like to control drilling and/or extraction operations. In some operations, hangers, such as tubing or casing hangers, may be used to suspend strings (e.g., piping for various fluid flows into and out of the well) in the well. Such hangers may be disposed or received in a housing, spool, or bowl. In addition to suspending strings inside the wellhead assembly, the hangers provide sealing to seal the interior of the wellhead assembly and strings from pressure inside the wellhead assembly.

In some applications, a hanger, such as a tubing hanger, is installed in the wellhead assembly via a running tool releasably coupled to the tubing hanger. The tubing hanger and running tool may be lowered towards the wellhead via a tubular string until the hanger is landed within the wellhead. In some applications, the running tool may also transport seal assemblies, locking members, and other accoutrements of the tubing hanger for installation within the wellhead for sealing and securing the tubing hanger therein. Additionally, the tubing hanger may include passages for the running of control lines downhole to control components and monitor conditions in a wellbore of the well system.

SUMMARY OF THE DISCLOSURE

An embodiment of a control line assembly for coupling with a tubing or casing hanger of a wellhead assembly comprises a support ring configured to couple with the tubing or casing hanger, a tubular member configured to extend through a first bore disposed in the support ring, wherein a first end of the tubular member is configured to be stabbed into a passage disposed in a wellhead component of the wellhead assembly, and a second end of the tubular member is configured to be stabbed into a first receptacle disposed in the tubing or casing hanger, wherein, when the control line assembly is coupled with the tubing or casing hanger and the wellhead component is landed over the tubing or casing hanger, a passage disposed in the tubular member is configured to provide communication between the passage of the wellhead component and the first receptacle of the tubing or casing hanger. In some embodiments, the support ring is configured to be lowered over a neck of the tubing or casing hanger and comprises a plurality of circumferentially spaced first bores configured to receive a plurality of the tubular members, the support ring comprises a plurality of circumferentially spaced second bores configured to receive a plurality of fasteners, and the tubing or casing hanger comprises a plurality of circumferentially spaced first receptacles configured to receive the plurality of tubular members and a plurality of circumferentially spaced second receptacles configured to receive and releasably couple with the fasteners. In some embodiments, the control line assembly further comprises a plurality of first seal assemblies configured to be received in the first receptacles of the tubing or casing hanger, wherein each of the first seal assemblies comprises an annular outer seal and an annular inner seal and a frustoconical interface disposed between the outer seal and the inner seal, wherein each of the tubular members comprises a flange including an annular shoulder configured to apply a compressive force to one of the first seal assemblies when the control line assembly is coupled with the tubing or casing hanger and the wellhead component is landed over the tubing or casing hanger. In certain embodiments, the control line assembly further comprises a guide ring configured to be lowered over the tubing or casing hanger when the control line assembly is coupled with the tubing or casing hanger and the wellhead component is landed over the tubing or casing hanger, wherein the guide ring comprises a first end, a second end, and a plurality of circumferentially spaced bores extending between the first and second ends and configured to receive the plurality of tubular members. In certain embodiments, the guide ring comprises a plurality of circumferentially spaced apertures extending into the first end of the guide ring, wherein the apertures are aligned with the bores of the guide ring, the control line assembly further comprises a plurality of spacer rings configured to be received in the receptacles of the guide ring, the control line assembly comprises a plurality of second seal assemblies configured to be disposed about the tubular members and landed against the spacer rings, wherein each of the second seal assemblies comprises an annular outer seal and an annular inner seal and a frustoconical interface disposed between the outer seal and the inner seal, and wherein the second seal assemblies are configured to be received in a plurality of receptacles extending into the wellhead component and aligned with a plurality of passages disposed in the wellhead component to seal a connection formed between the passages of the wellhead component and the passages of the tubular members when the control line assembly is coupled with the tubing or casing hanger and the wellhead component is landed over the tubing or casing hanger. In some embodiments, an outer surface of the tubular member comprises an annular seal configured to sealingly engage an inner surface of the passage of the wellhead component when the control line assembly is coupled with the tubing or casing hanger and the wellhead component is landed over the tubing or casing hanger. In some embodiments, the control line assembly further comprises a plurality of the support rings, wherein each support ring is configured to be received in one of a plurality of first receptacles of the tubing or casing hanger, and a plurality of first seal assemblies configured to be received in the plurality of first receptacles of the tubing or casing hanger, wherein, the support rings are configured to apply a compressive force to the first seal assemblies in response to the application of torque to the support rings. In certain embodiments, an outer surface of each support ring comprises a connector configured to releasably couple with a corresponding connector disposed on an inner surface of each first receptacle of the tubing or casing hanger.

An embodiment of a wellhead assembly comprises a tubing or casing hanger disposed in a housing, wherein the tubing or casing hanger comprises a central bore and a first receptacle offset from the central bore, a wellhead component coupled to the housing, wherein the wellhead component comprises a central bore that receives an upper end of the tubing or casing hanger and a passage that is offset from the central bore, and a tubular member having a first end received in the passage of the wellhead component and a second end received in the first receptacle of the tubing or casing hanger to provide communication between the passage of the wellhead component and the passage of the tubing or casing hanger. In some embodiments, the wellhead component comprises a seal flange adapter configured to couple the housing with a production tree of the wellhead assembly. In some embodiments, the wellhead assembly further comprises a load ring releasably coupled to an outer surface of the tubing or casing hanger, and an annular seal assembly disposed about the tubing or casing hanger and in engagement with an end of the load ring, wherein the seal assembly is configured to sealingly engage the outer surface of the tubing or casing hanger and an inner surface of the wellhead component. In certain embodiments, an axial position of the load ring relative to the tubing or casing hanger is adjustable to control an amount of compressive force applied to the seal assembly by the end of the load ring and an annular shoulder of the wellhead component. In certain embodiments, the wellhead assembly further comprises a test port disposed in the wellhead component and configured to apply fluid pressure to the seal assembly. In some embodiments, the wellhead assembly further comprises a first seal assembly disposed in the first receptacle of the tubing or casing hanger, wherein the first seal assembly is disposed about the tubular member and comprises an annular outer seal and an annular inner seal and a frustoconical interface disposed between the outer seal and the inner seal, a guide ring disposed about the tubing or casing hanger and landed against an annular shoulder of the housing, wherein the guide ring comprises a bore through which the tubular member extends and a receptacle aligned with the bore that receives a spacer ring that is disposed about the tubular member, and a second seal assembly disposed about the tubular member and received in a receptacle of the wellhead component that is in signal communication with the passage of the wellhead component, wherein the second seal assembly is engaged by the spacer ring and an annular shoulder of the receptacle. In some embodiments, an outer surface of the support ring comprises a connector configured to releasably couple with a corresponding connector disposed on an inner surface of the first receptacle of the tubing or casing hanger, and the support ring is configured to apply a compressive force to the first seal assembly in response to the application of torque to the support ring. In certain embodiments, the tubular member comprises an outer surface including an annular seal that seals against an inner surface of the passage of the wellhead component.

An embodiment of a method for installing a tubing or casing hanger in a wellhead assembly comprises coupling a control line assembly to the tubing or casing hanger, wherein the control line assembly comprises a tubular member having a first end and a second end that is received in a first receptacle of the tubing or casing hanger, landing the tubing or casing hanger in a housing of the wellhead assembly, landing a wellhead component over a first end of the tubing or casing hanger, and stabbing the first end of the tubular member into a passage disposed in the wellhead component. In some embodiments, the method further comprises coupling the tubing or casing hanger with a running tool, and stabbing the first end of the tubular member into a passage disposed in the running tool to provide communication between the passage of the running tool and the first receptacle of the tubing or casing hanger. In some embodiments, the method further comprises applying a torque to a support ring of the control line assembly to compress a seal assembly disposed between an annular shoulder of the tubular member and an annular shoulder of the first receptacle of the tubing or casing hanger. In certain embodiments, the method further comprises disposing a plurality of fasteners in a plurality of circumferentially spaced bores disposed in a support ring of the control line assembly, and coupling the plurality of fasteners to a plurality of circumferentially spaced second apertures extending into the tubing or casing hanger to couple the control line assembly with the tubing or casing hanger.

An embodiment of a running tool comprises a carrier ring configured to releasably couple with a tubing or casing hanger, wherein the carrier ring comprises a control line passageway, an inner sleeve slidably disposed about the carrier ring, wherein the inner sleeve comprises a control line passageway aligned with the control line passage way of the carrier ring, and an outer sleeve slidably disposed about the inner sleeve, wherein the outer sleeve comprises a control line passageway aligned with the control line passage way of the carrier ring, wherein the control line passageway of each of the carrier ring, inner sleeve, and outer sleeve, are configured to receive a control line extending through each of the carrier ring, inner sleeve, and outer sleeve. In some embodiments, the running tool further comprises an inner mandrel disposed in and coupled with the carrier ring, wherein the inner mandrel is configured to releasably couple with a conveyance string. In some embodiments, the running tool further comprises an energizing ring slidably disposed between the carrier ring and the inner mandrel, and a running tool lock ring supported by the carrier ring, wherein the running tool lock ring comprises a radially outer unlocked position and a radially inner locked position, wherein the energizing ring is configured to actuate the running tool lock ring between the unlocked and locked positions in response to axial displacement of the energizing ring. In certain embodiments, when the running tool lock ring is disposed in the locked position, the running tool lock ring is configured to lock against a control line assembly. In certain embodiments, the control line assembly is configured to couple with the tubing or casing hanger. In some embodiments, the running tool further comprises a retainer ring disposed about the inner mandrel, the retainer ring comprising a control line passage configured to receive a penetrator, wherein the penetrator is slidingly received in a control line passage of the inner sleeve. In some embodiments, the penetrator comprises a control line passage that is configured to receive the control line. In certain embodiments, the retainer ring comprises an actuation passage in fluid communication with an annular chamber, the inner sleeve is configured to actuate a lock ring of a seal assembly in response to pressurization of the annular chamber. In certain embodiments, the outer sleeve is configured to actuate a seal assembly of the tubing or casing hanger in response to axial displacement of the outer sleeve. In some embodiments, the inner sleeve is configured to actuate a lock ring of the seal assembly to lock an annular seal of the seal assembly in an energized position in response to axial displacement of the inner sleeve.

An embodiment of a control line assembly comprises a control line mandrel comprising an outer surface including a flange extending radially outwards therefrom, a stab connector coupled to the flange of the control line mandrel, wherein the stab connector is configured to stab into a receptacle of a running tool, a first control line in signal communication with the stab connector, and a second control line received in a pocket extending into the outer surface of the flange of the control line mandrel, wherein the control line mandrel is configured to couple with a tubing or casing hanger. In some embodiments, the second control line is configured to provide a continuous control signal pathway that extends between a signal source and a signal destination. In some embodiments, the pocket extends into the flange of the control line mandrel. In certain embodiments, the control line assembly further comprises control line passage extending through the flange of the control line mandrel, wherein the control line passage is in fluid communication with the stab connector. In certain embodiments, the control line assembly further comprises a first control line connector coupled to the flange of the control line mandrel, wherein the first control line connector is in fluid communication with the control line passage of the flange and is coupled to a first end of the first control line. In some embodiments, a second end of the first control line is coupled to a second control line connector that is coupled to the tubing or casing hanger. In some embodiments, the outer surface of the control line mandrel comprises a locking groove configured to receive a lock ring of a running tool to lock the control line mandrel to the running tool.

An embodiment of a method for installing a tubing or casing hanger in a wellhead assembly comprises stabbing a stab connector of a control line mandrel into a receptacle of a running tool to provide fluid communication between the receptacle and a first control line coupled to the control line mandrel, extending a second control line from a running tool through a pocket formed in an outer surface of the control line mandrel, coupling the control line mandrel to a tubing or casing hanger, and landing the tubing or casing hanger in a housing of the wellhead assembly. In some embodiments, the method further comprises extending the second control line through a control line passage extending through the tubing or casing hanger. In some embodiments, the method further comprises disposing a lock ring of the running tool into a locking groove formed in the outer surface of the control line mandrel to lock the control line mandrel with the running tool.

BRIEF DESCRIPTION OF THE DRAWINGS

For a detailed description of exemplary embodiments, reference will now be made to the accompanying drawings in which.

DETAILED DESCRIPTION

Figure 1:
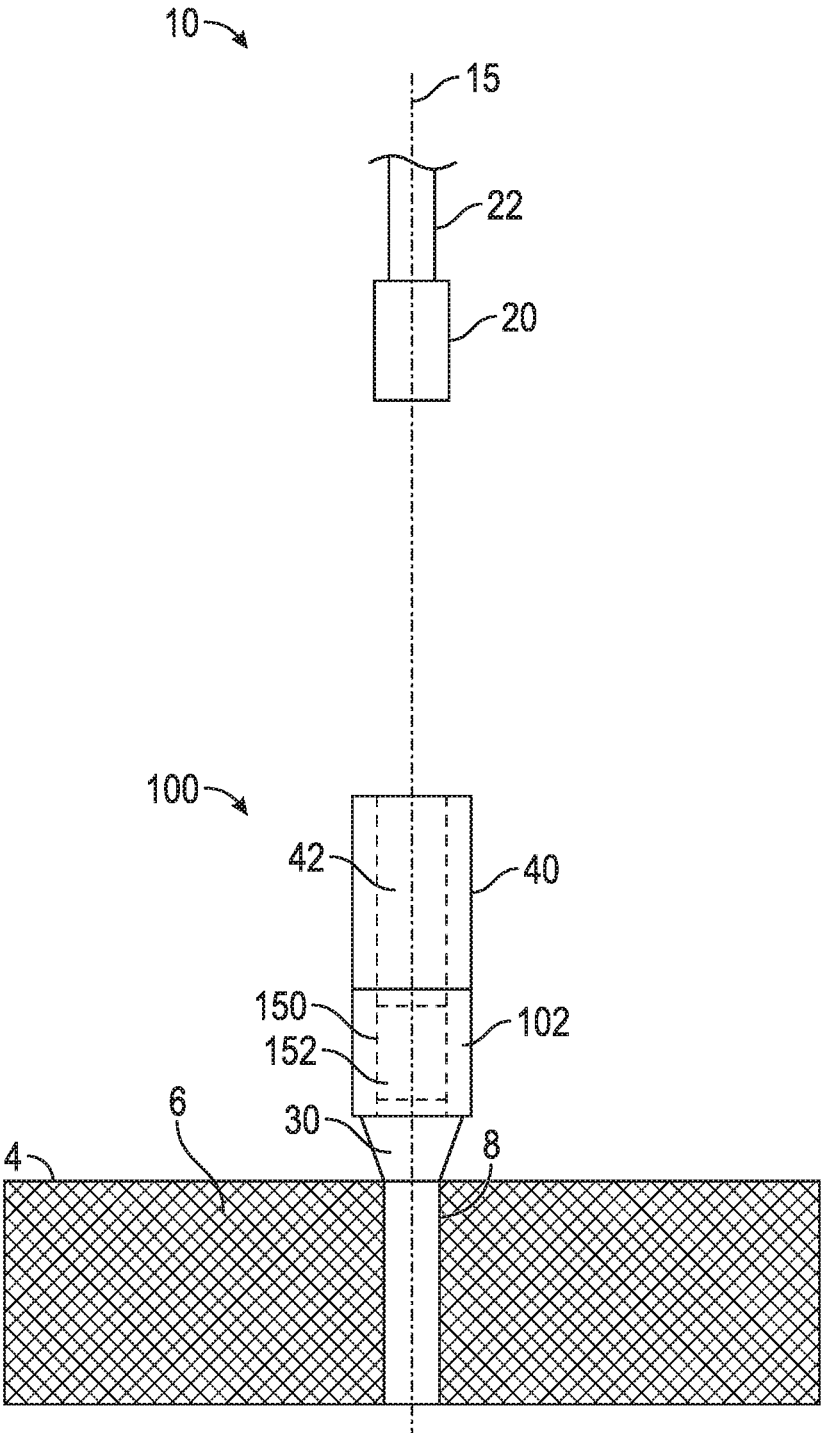
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 10 having a central or longitudinal axis 15. The well system 10 can be configured to extract various minerals and natural resources, including hydrocarbons (e.g., oil and/or natural gas), or configured to inject substances into an earthen surface 4 and an earthen formation 6 via a well or wellbore 8. In some embodiments, the well system 10 is land-based, such that the surface 4 is land surface, or subsea, such that the surface 4 is the seal floor. The system 10 includes a wellhead assembly 100 including a wellhead housing 102 and a running tool assembly 20 conveyed by a tubular member or conveyance string 22. The wellhead housing 102 of wellhead assembly 100 is coupled to a wellbore 8 via a wellhead connector or hub 30. Wellhead housing 102 typically includes multiple components that control and regulate activities and conditions associated with the wellbore 8. For example, wellhead housing 102 generally includes bodies, valves and seals that route produced fluids from the wellbore 8, provide for regulating pressure in the wellbore 8, and provide for the injection of substances or chemicals downhole into the wellbore 8. Although in the embodiment shown in FIG. 1 wellhead assembly 100 forms a part of well system 10, in other embodiments, wellhead assembly 100 may be used in other well systems.

In the embodiment shown in FIG. 1, wellhead assembly 100 of well system 10 additionally includes a production or Christmas tree 40 coupled to wellhead housing 102. Tree 40 may include a variety of valves, fittings, and controls to control the routing of fluids produced from the formation 6 via wellbore 8, and to allow for the injection fluids and the disposal of tools within wellbore 8. In the embodiment shown in FIG. 1, Tree 40 includes a central bore or passage 42 extending therethrough. Additionally, in this embodiment, wellhead assembly 100 includes a wellhead component 150 disposed within wellhead housing 102. In this embodiment, wellhead component 150 comprises a tubing or casing hanger 150. For ease of description below, reference to "tubing" shall include casing and other tubulars associated with wellheads. Further, "housing" may also be referred to as "spool," "receptacle," or "bowl." In some embodiments, wellhead assembly 100 may include additional components not shown in FIG. 1, such as a blowout preventer (BOP) stack for selectably sealing or isolating the wellbore 8.

As will be explained further herein, hanger 150 of wellhead assembly 100 may be installed in or coupled with wellhead housing 102 using a running tool suspended from a conveyance tool or string, such as tool 20 and conveyance string 22. Additionally, as will also be discussed further herein, additional assemblies associated or coupled with hanger 150, such as seal assemblies, locking mechanisms, and control line subs configured to allow for the installation of control lines and the passage of control signals between components of wellhead assembly 100 and/or other systems or components of well system 10, may also be installed within wellhead housing 102 using a running tool suspended from a conveyance tool or string, such as tool 20 and conveyance string 22. In this embodiment, conveyance string 22 comprises a conveyance or tool string lowered from a surface platform or rig (not shown in FIG. 1). In other embodiments, instead of using a conveyance string such as string 22 for supporting and displacing running tool 20, running tool 20 may be suspended over and/or lowered into the wellhead housing 102 via a crane or other supporting device.

In the embodiment shown in FIG. 1, hanger 150 of wellhead assembly 100 includes a central bore or passage 152 that fluidly couples with and enables fluid communication between the bore 42 of tree 40 and wellbore 8. Thus, bores 42 and 152 provide access to the wellbore 8 for various completion, production, and workover procedures. For example, components can be run down to the wellhead housing 102 and disposed therein to seal off the wellbore 8, to inject fluids downhole, to suspend tools downhole, to retrieve tools downhole, receive production or well fluids from the formation 6 via wellbore 8, and the like. In some embodiments, additional casing and/or tubing hangers, as well as other components, may be installed within wellhead housing 102. As one of ordinary skill in the art understands, the wellbore 8 may contain elevated pressures. For example, the wellbore 8 may include pressures that exceed 10,000 pounds per square inch (PSI). Accordingly, well system 10 employs various mechanisms, such as mandrels, seals, plugs and valves, to control and regulate the wellbore 8. For example, the hanger 150 may be disposed within the wellhead housing 102 to secure tubing and casing suspended in the wellbore 8, and to provide a path for hydraulic control fluid, chemical injections, and the like.

Figure 2:
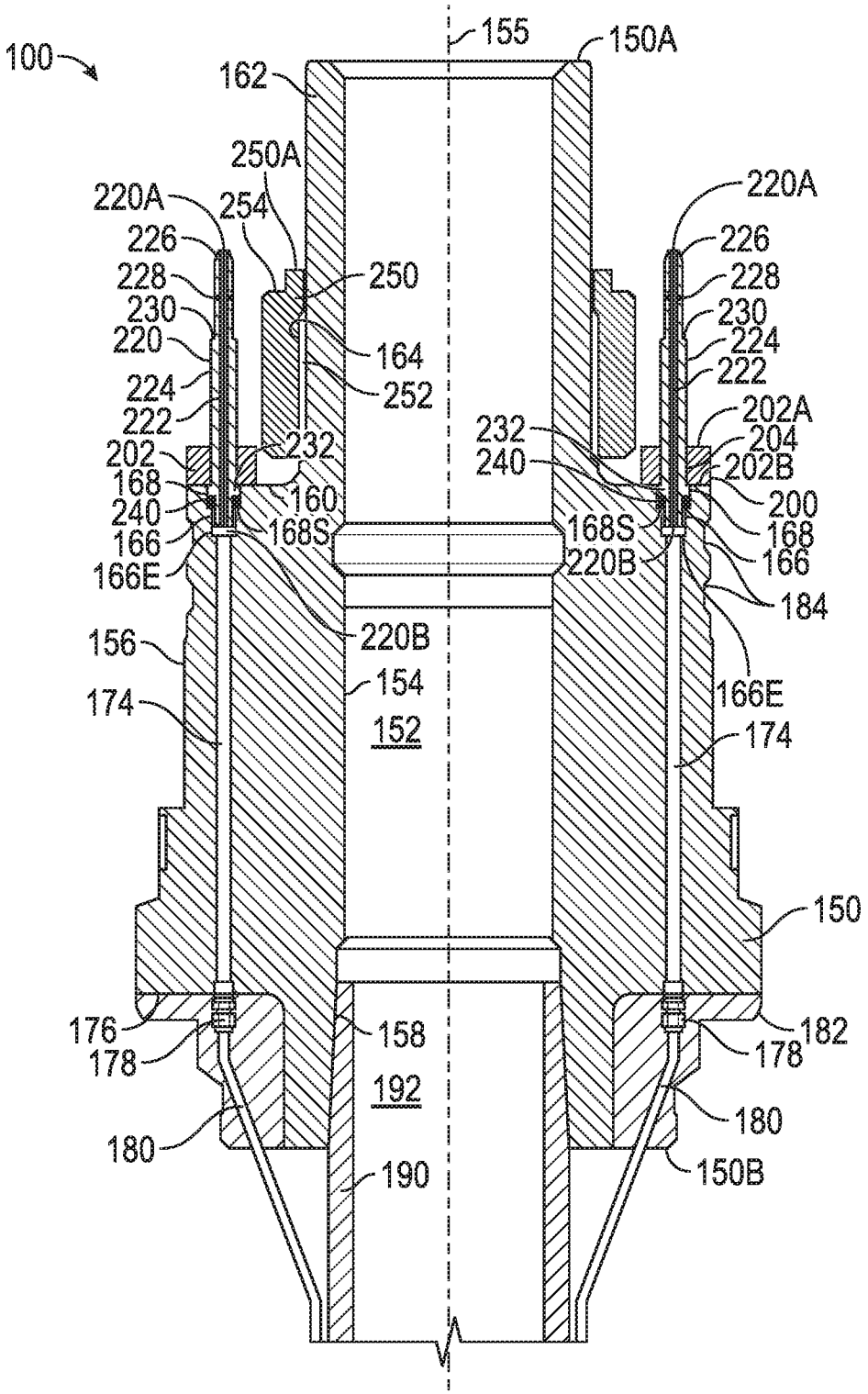
FIG. 2 is a cross-sectional view of an embodiment of a control line sub assembly and a hanger of the well system of FIG. 1 in accordance with principles disclosed herein.
Figure 3:
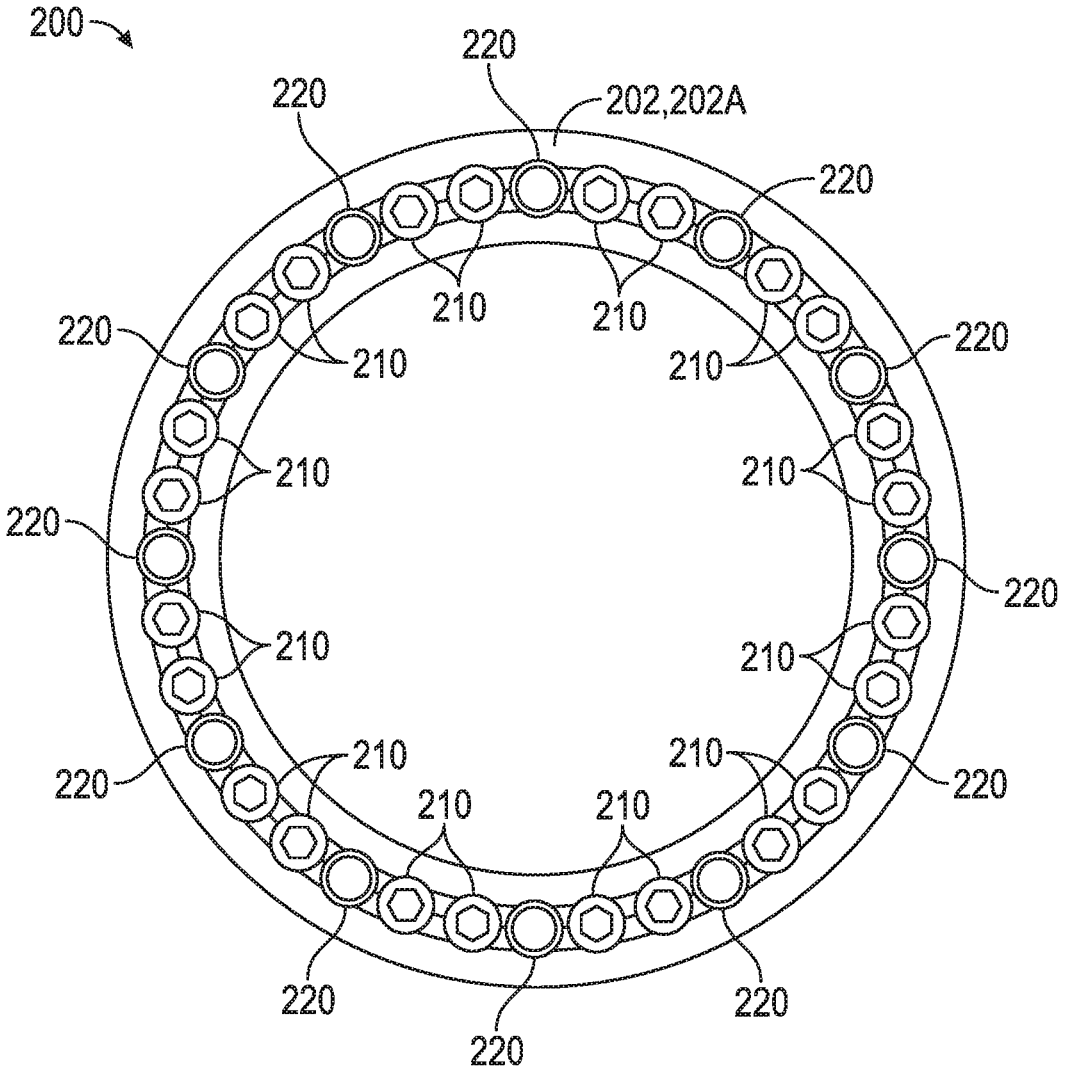
FIG. 3 is a top view of the control line sub assembly of FIG. 2.

Referring to FIGS. 1-3, an embodiment of hanger 150 and a control line sub assembly 200 of the wellhead assembly 100 of FIG. 1 are shown in FIGS. 2 and 3. In the embodiment shown in FIGS. 2 and 3, hanger 150 has a central or longitudinal axis 155 and generally includes a first or upper end 150A, a second or lower end 150B, a cylindrical inner surface 154 extending between ends 150A and 150B that defines central bore 152, and a generally cylindrical outer surface 156 extending between ends 150A and 150B. Central axis 155 of hanger 150 is disposed substantially coaxial with central axis 15 of well system 10 when hanger 150 is coupled with wellhead housing 102. Hanger 150 is releasably coupled with a tubular member or tubing 190 suspended therefrom. Particularly, the portion of inner surface 154 of hanger 150 proximal lower end 150B includes a releasable connector 158 for coupling with a corresponding releasable connector of tubing 190. In some embodiments, connector 158 comprises a threaded connector 158, such as a premium or sealed connector; however, in other embodiments, connector 158 may comprise other connectors known in the art. In the embodiment shown in FIGS. 1-3, tubing 190 comprises production tubing 190 having a central bore or passage 192 in fluid communication with central bore 152 of hanger 150. In some embodiments, tubing 190, following the installation of tubing hanger 150 and associated components in wellhead housing 102, is configured to act as a conduit for conveying production fluids from wellbore 8 to the wellhead housing 102 and tree 40.

In the embodiment shown in FIGS. 2 and 3, the outer surface 156 of hanger 150 includes a first or upper annular shoulder 160 facing upper end 150A. A generally cylindrical neck 162 extends axially between upper end 150A and the upper shoulder 160. A releasable connector 164 is disposed on the outer surface 156 of hanger neck 162. As will be discussed further herein, releasable connector 164 is configured to releasably engage and couple with a corresponding releasable connector of an annular adjustable load ring 250 disposed about neck 162 of hanger 150. In some embodiments, releasable connector 164 comprises a threaded connector; however, in other embodiments, connector 164 may comprise other releasable connectors known in the art.

Figure 9:
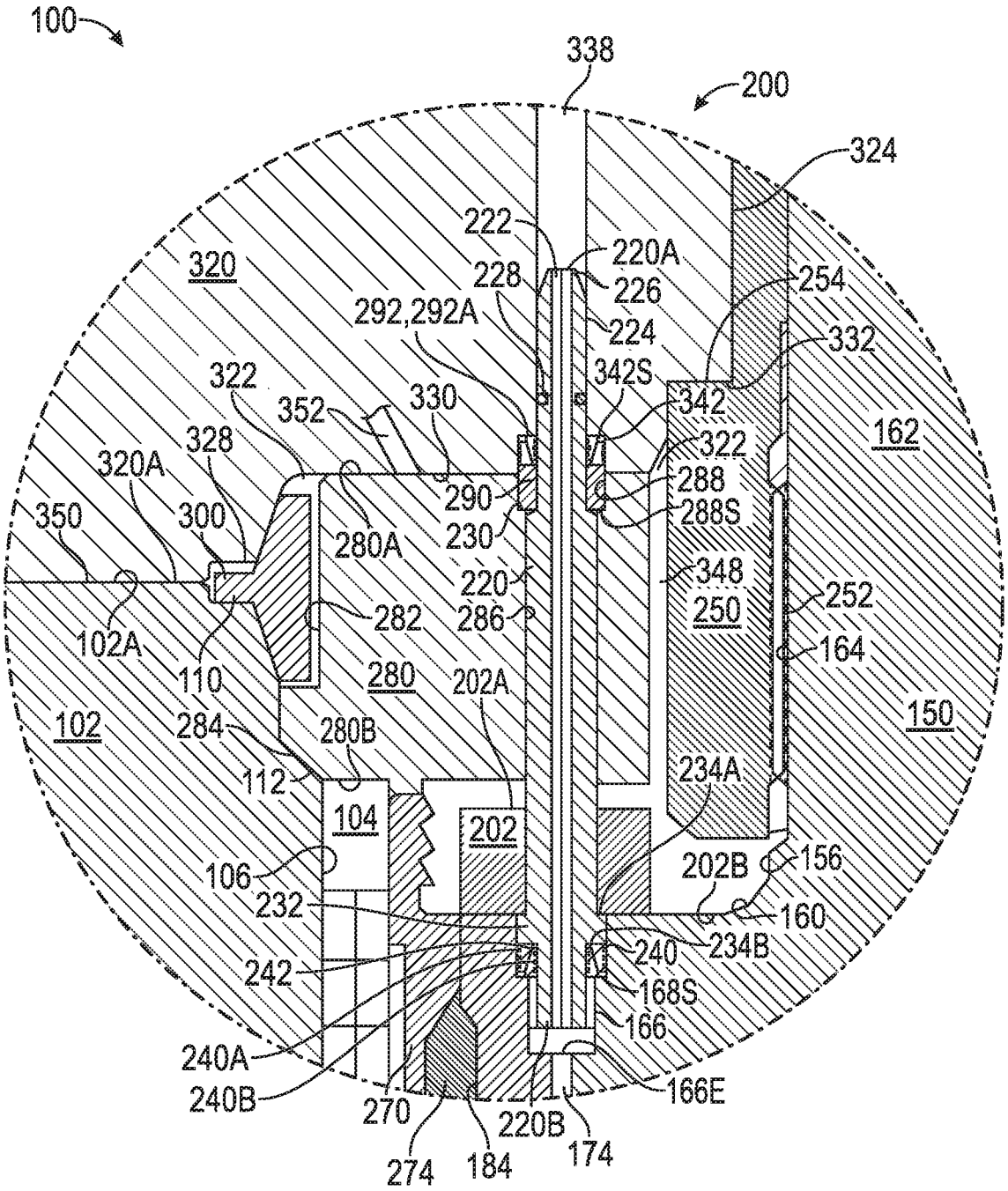
FIG. 9 is a zoomed-in cross-sectional view of the control line sub assembly of FIG. 2.
Figure 10:
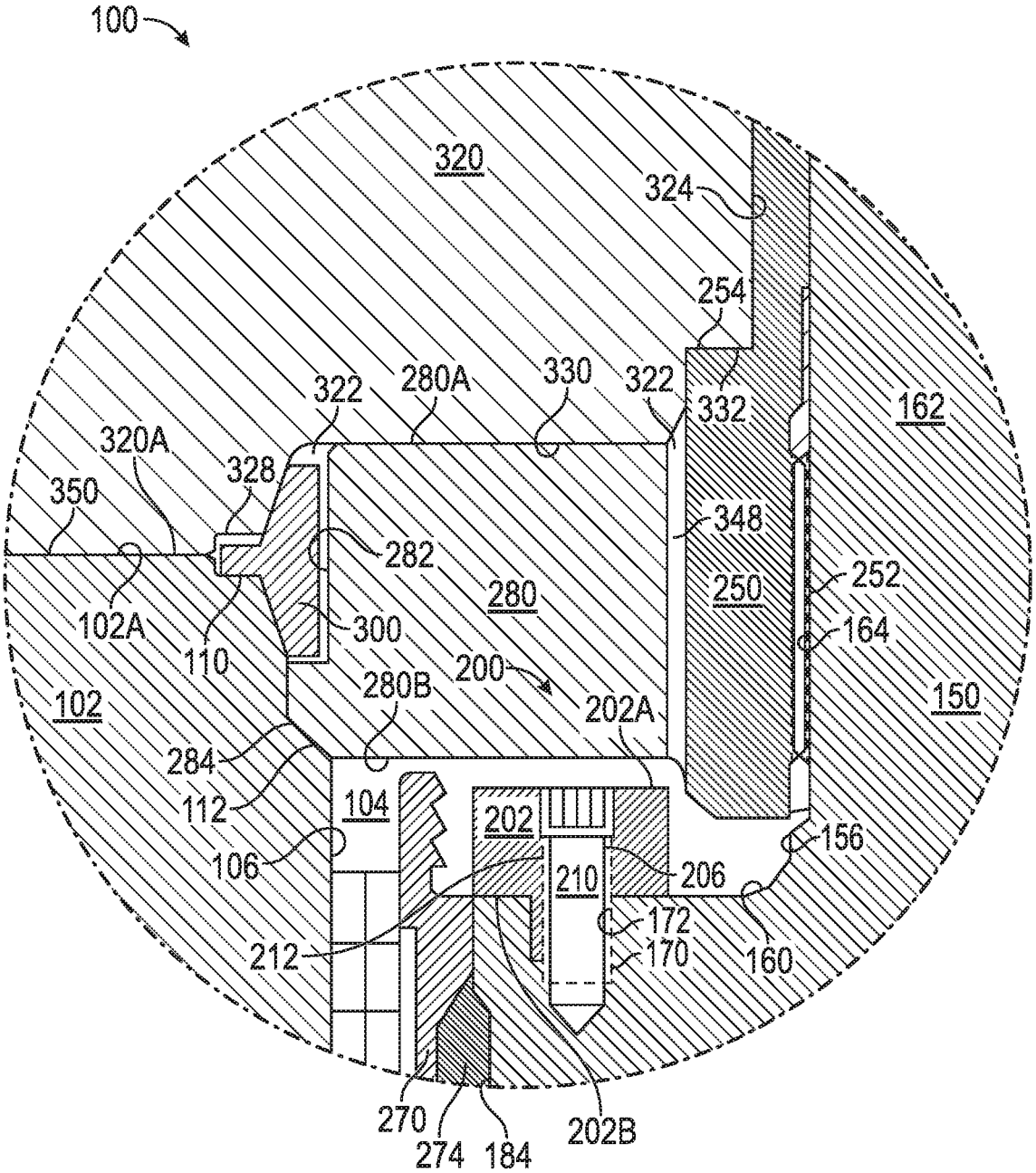
FIG. 10 is another zoomed-in cross-sectional view of the control line sub assembly of FIG. 2.

Referring to FIGS. 2, 9, and 10, upper shoulder 160 of hanger 150 includes a plurality of circumferentially spaced first bores or receptacles 166 (shown in FIGS. 2 and 9) and a plurality of circumferentially spaced second bores or receptacles 170 (shown in FIG. 10) extending therein. For clarity, FIG. 9 illustrates a cross-section of hanger 150 that intersects a central or longitudinal axis of one of the first bores 166, while FIG. 10 illustrates a cross-section of hanger 150 that intersects a central or longitudinal axis of one of the second bores 170. In other words, the cross-section of FIG. 10 is circumferentially spaced or offset from the cross-section of FIG. 9. In the embodiment shown in FIGS. 2, 9, and 10, each first bore 166 extending into shoulder 160 includes a counterbore 168 extending therein from upper shoulder 160, where counterbore 168 has an enlarged or greater diameter than the portion of first bore 166 that extends between a lower end of counterbore 168 (i.e., the end of counterbore 168 spaced from upper shoulder 160) and a lower terminal end 166E of bore 166. The enlarged diameter of counterbore 168 of each first bore 166 forms an annular shoulder 168S therein at the lower end of counterbore 168. As will be discussed further herein, each first bore 166 of hanger 150 is configured to receive at least a portion of a tubular member or stab connector 220 of control line sub 200. In this embodiment, each second bore 170 includes a releasable connector 172 (shown in FIG. 10) disposed on an inner surface thereof. As will be discussed further herein, the releasable connector 172 of each second bore 170 is configured to releasably couple with a corresponding fastener 210 of control line sub 200.

In the embodiment shown in FIGS. 2, 9, and 10, a plurality of circumferentially spaced control line passages 174 extend through hanger 150 (each radially offset from central axis 155). Particularly, each control line passage 174 extends between the terminal end 166E of a first bore 166 and a second or lower annular shoulder 176 of the outer surface 156 of hanger 150 that is axially spaced from upper annular shoulder 160. Additionally, in this embodiment, a control line fitting 178 is coupled to a lower end of each circumferentially spaced control line passage 174 (i.e., the end of passage 174 disposed at lower shoulder 176), where fitting 178 receives or couples with a corresponding control line 180. In some embodiments, control lines 180 may be wrapped about or otherwise secured to tubing 190 coupled with hanger 150.

Control line passages 174 and control lines 180 are configured to facilitate the transmission of control signals through hanger 150 and to other components of well system 10, such as actuatable downhole valves, sensors, or other features. In the embodiment shown in FIGS. 2, 9, and 10, control lines 180 and control line passages 174 are configured to provide for the transport of fluid or hydraulic control signals therethrough, which may comprise the communication of fluid flow and/or fluid pressure through passages 174 and lines 180. Thus, each control line passage 174 is in signal communication (e.g., fluid communication, etc.) with a corresponding first bore 166 and a corresponding control line 180, where a fitting 178 seals the connection formed between each passage 174 and line 180 from the surrounding environment. However, in other embodiments, control line passages 174 and control lines 180 are configured to provide for the conveyance of other control signals, such as electrical signals, optical signals, acoustic signals, and the like. For instance, in some embodiments, an electrical cable may be disposed in each control line passage 174 and corresponding control line 180 to provide for the conduction of electrical control signals therethrough. In the embodiment shown in FIGS. 2, 3, 9, the outer surface 156 of hanger 150 additionally includes an annular landing shoulder or profile 182 located axially between lower annular shoulder 176 and lower end 150B, and a plurality of axially spaced annular locking or coupling grooves 184 located axially between upper shoulder 160 and lower shoulder 176.

Referring to FIGS. 2, 3, 9, and 10, control line sub 200 is coupled with hanger 150 and is generally configured to provide one or more externally accessible connection (e.g., accessible via an outer surface of wellhead assembly 100 of well system 10) with control line passages 174 and control lines 180 following the assembly of wellhead assembly 100 of well system 10. In this manner, control line sub 200 is configured to provide for the transmission of control signals (i.e., are configured to provide signal communication) between the external connections and control lines 180 following the assembly of wellhead assembly 100. In the embodiment shown in FIGS. 2, 3, 9, and 10, control line sub 200 generally includes an annular support ring 202, the plurality of circumferentially spaced fasteners 210, and the plurality of circumferentially spaced stab connectors 220.

Support ring 202 of control line sub 200 is configured to physically support stab connectors 220. In the embodiment of FIGS. 2, 3, 9, and 10, support ring 220 is generally annular in shape and includes a first or upper end 202A and a second or lower end 202B, a central bore defined by an inner surface extending between ends 202A and 202B, an outer surface extending between ends 202A and 202B, a plurality of circumferentially spaced first or stab apertures or bores 204 (shown in FIG. 9), and a plurality of circumferentially spaced second or fastener apertures or bores 206 (shown in FIG. 10), where apertures 204 and 206 each extend between ends 202A and 202B. When coupled with hanger 150, the lower end 202B of support ring 202 is disposed directly adjacent or physically engages upper shoulder 160 of hanger 150. Each stab aperture 212 receives a corresponding stab connector 220 while each fastener aperture receives a corresponding fastener 210. As shown particularly in FIG. 3 (hanger 150 and load ring 250 are hidden in FIG. 3 for clarity), in the embodiment of FIGS. 2, 3, 9, and 10, control line sub 200 includes twelve circumferentially spaced stab connectors 220 and twenty four fasteners 210, with two fasteners 210 positioned between each pair of arcuately adjacent stab connectors 220. However, in other embodiments, control line sub 200 may include varying number of stab connectors 220 and fasteners 210 in varying relative positions (e.g., a single fastener 210 may be positioned between each adjacent pair of connectors 220, etc.).

Fasteners 210 of control line sub 200 are configured to releasably couple control line sub 200 with hanger 150. In the embodiment of FIGS. 2, 3, 9, and 10, each fastener 210 includes a releasable connector 212 (shown in FIG. 10)

disposed on an outer surface thereof for releasably coupling with the releasable connector 172 of a corresponding second bore 170 of hanger 150. In this embodiment, connectors 212 of fasteners 210 and connectors 172 of second bores 170 comprise threaded connectors for forming a threaded connection therebetween; however, in other embodiments, connectors 212 and 172 may comprise other releasable connectors known in the art. In still other embodiments, support ring 202 may be permanently coupled or affixed to hanger 150.

Stab connectors 220 of control line sub 200 are configured to provide signal communication or the transmission of control signals (e.g., hydraulic, electric, optical, and/or acoustic signals) to and from the control line passages 174 of hanger 150. As shown particularly in FIG. 9, in the embodiment of FIGS. 2, 3, 9, and 10, each stab connector 220 is elongate in shape and includes a first or upper end 220A, a second or lower end 220B, a central bore or passage 222 extending between ends 220A and 220B and defined by a generally cylindrical inner surface, and a generally cylindrical outer surface 224 extending between ends 220A and 220B. In this embodiment, stab connectors 220 are formed or comprise a rigid material configured to resist deformation. In some embodiments, stab connectors 220 are formed from or comprise a metal or metal alloy. The outer surface 224 of each stab connector 220 includes an angled or frustoconical profile 226 at upper end 220A and an annular seal 228 proximal to, but axially from upper end 220A. In some embodiments, annular seal 228 comprises an elastomeric seal. Additionally, outer surface 224 includes a first or upper annular shoulder 230 facing upper end 220A, and a radially outwards extending flange 232 located proximal to, but axially spaced from lower end 220B, where flange 232 forms an upper shoulder 234A facing upper end 220A and a lower annular shoulder 234B facing lower end 220B.

When control line sub 200 is coupled with hanger 150, the lower end 220B of each stab connector 220 is received in a corresponding first bore 166 of hanger 150, where an outer diameter of flange 232 is substantially equal to, but slightly less than an inner diameter of the counterbore 168 of first bore 166 while an outer diameter of the portion of connector 220 extending between lower shoulder 234B and lower end 220B is substantially equal to, but slightly less than an inner diameter of the portion of first bore 166 extending between annular shoulder 168S and terminal end 166E. In this arrangement, engagement between the outer surface 224 of stab connector 220 and the inner surface of first bore 166 maintains stab connector 220 in a position such that a central or longitudinal axis of stab connector 220 is substantially parallel with central axis 155 of hanger 150. In other words, engagement between the outer surface 224 of stab connector 220 and the inner surface of first bore 166 maintains or positions stab connector 220 in a substantially vertical position.

When inserted into a respective first bore 166 of hanger 150, signal communication (e.g., fluid communication, etc.) is provided between central bore 222 of each stab connector 220 and the control line passage 174 extending from the first bore 166 in which each connector 220 is received. In the embodiment of FIGS. 2, 3, and 10, a plurality of annular support ring seal assemblies 240 are positioned within the counterbore 168 of first bores 166 prior to the insertion of stab connectors 220 therein. Following the insertion of a stab connector 220 in its respective first bore 166, an outer annular seal 240A of assembly 240 sealingly engages the inner surface of first bore 166 and lower shoulder 234B of the flange 232 of stab connector 220, while an inner annular seal 240B of assembly 240 sealingly engages the outer surface 224 of connector 220 and the shoulder 168S of counterbore 168. In some embodiments, seals 240A and 240B comprise metal seals; however, in other embodiments, seals 240A and 240B may comprise varying materials and geometries. In some embodiments, seals 240A and 240B of assembly 240 comprise Swagelok® seals (available from the Swagelok Company, Solon, Ohio). Additionally, an angled or inclined inner surface of outer seal 240A sealingly engages an angled or inclined outer surface of inner seal 240B, forming an annular and angled or frustoconical interface 242 (shown in FIG. 9) formed therebetween. In this arrangement, support ring seal assembly 240 seals the connection formed between central bore 222 of stab connector 220 and the control line passage 174 extending from first bore 166 from the surrounding environment. Although in the embodiment of FIGS. 2, 3, and 10 stab connectors 220 of control line sub 200 are separate and distinct from support ring 202, being slidably received in stab apertures 204 of ring 202, in other embodiments, stab connectors 220 and support ring 202 may comprise a single, unitary or monolithically formed component.

Referring to FIGS. 2-4, 9, and 10, FIGS. 2 and 4 illustrate part of an embodiment of a procedure for installing hanger 150 and control line sub 200 in wellhead housing 102 of the wellhead assembly 100. Particularly, FIG. 2 illustrates hanger 150 following the coupling of control line sub 200 and load ring 250 therewith. In an embodiment, control line sub 200 may be coupled or installed on hanger 150 by placing support ring seal assemblies 240 within first bores 166 of hanger 150, slidably receiving stab connectors 220 in stab apertures 204 and fasteners 210 in fastener apertures 206 of support ring 202, and then inserting stab connectors 220 into first bores 166 with the lower end 202B of support ring 202 resting on upper shoulder 160 of hanger 150. With stab connectors 220 positioned in first bores 166, fasteners 210 may be releasably or threadably coupled to their respective second bores 170 via releasable connectors 212 and 172 of fasteners 210 and bores 170, respectively. In some embodiments, the torque applied to fasteners 210 to couple fasteners 210 with their respective second bores 170 of hanger 150 energize the support ring seal assemblies 240 of control line sub 200 such that assemblies 240 provide a robust or effective seal of the connection formed between central bores 222 of stab connectors 220 and control line passages 174 of hanger 150. Particularly, in some embodiments, torque applied to fasteners 210 is translated into an axially downwards directed force against upper shoulder 234A of the flange 232 of stab connectors 220, which is transmitted to support ring seal assemblies 240 via engagement from lower shoulder 234B of the flange 232 of connectors 220. Thus, support ring seal assemblies 240 are compressed by stab connectors 220, wedging the angled inner surface of each outer seal 240A against the angled outer surface of each corresponding inner seal 240B. However, in other embodiments, support ring seal assemblies 240 are configured to provide a sealed connection without the application of a compressive force thereagainst.

In some embodiments, following the coupling of control line sub 200 with hanger 150, load ring 250 is coupled with neck 162 of hanger 150 by threadably coupling a releasable connecter 252 positioned on an inner surface of load ring 250 with releasable connector 164 of hanger 150. In the embodiment of FIGS. 2-4, 9, and 10, load ring 250 includes a first or upper annular end 250A and an annular shoulder 254 axially spaced and extending radially outwards from upper end 250A.

Following the coupling of control line sub 200 and load ring 250 with hanger 150, hanger 150 is coupled with a running tool 260 configured to convey and land hanger 150 in the wellhead housing 102 of wellhead assembly 100. Thus, running tool 260 comprises an embodiment of the running tool 20 of the well system 10 shown in FIG. 1. Thus, in some embodiments, running tool 260 may be conveyed via a conveyance string such as string 22 of FIG. 1, or via other mechanisms such as via a crane or other supporting device. In the embodiment of FIGS. 2-4, 9, and 10, running tool 260 generally includes a central bore 262 for receiving the neck 162 of hanger 150, and a plurality of circumferentially spaced control line passages 264, where each passage 264 is in signal communication (e.g., fluid communication, etc.) with a corresponding control line 268 via a control line fitting 266 that seals the connection formed between the passage 264 and line 268. Control line passages 264 are radially and circumferentially positioned in running tool 260 such that stab connectors 220 of control line sub 200 may be slidably received therein when hanger 150 and sub 200 are coupled with running tool 260. Additionally, in this embodiment, a lower end of running tool 260 is releasably coupled with an annular seal assembly 270 that generally includes a plurality of annular hanger seals 272 and an annular lock ring or coupling member 274. Lock ring 274 of seal assembly 270 is at least partially received in locking grooves 184 of hanger 150 to restrict relative axial movement between hanger 150 and the running tool 260 coupled with seal assembly 270. In this embodiment, running tool 260 comprises a stab-on running tool 260 configured to couple with hanger 150 via relative axial displacement between tool 260 and hanger 150. In other words, running tool 260 is coupled with hanger 150 by stabbing hanger 150 into tool 260 with lock ring 274 locking into locking grooves 184 of hanger 150.

Figure 4:
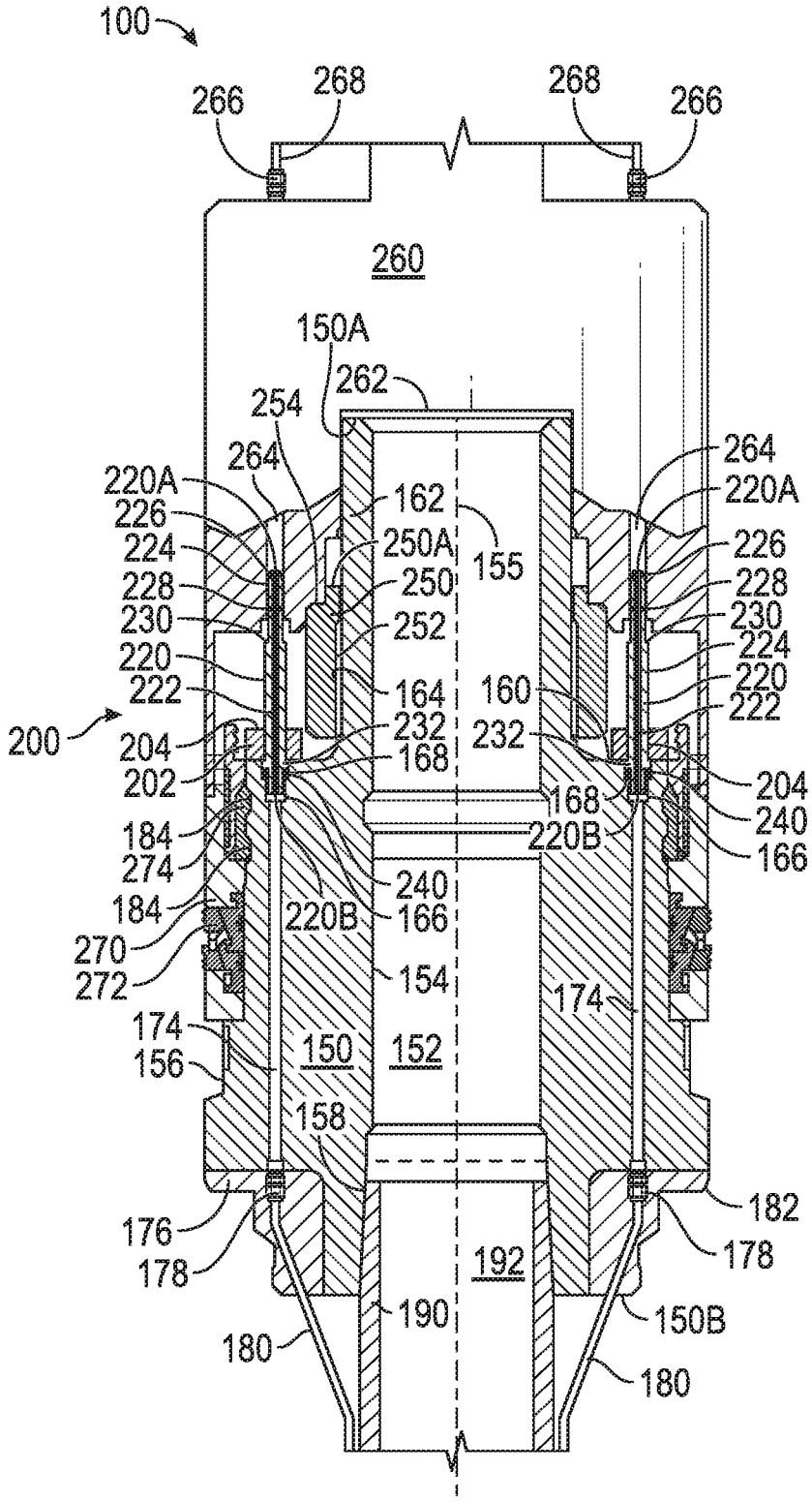
FIG. 4 is a partial cross-sectional view of an embodiment of a running tool of the well system of FIG. 1, and the control line sub assembly and hanger of FIG. 2 in accordance with principles disclosed herein.

As shown particularly in FIG. 4, when running tool 260 is coupled with hanger 150 lock ring 274 is in physical engagement with locking grooves 184 of hanger 150, neck 162 of hanger 150 is received in central bore 262 of running tool 260, and the upper end 220A of stab connectors 220 are received in control line passages 264. Additionally, an outer surface of load ring 250 is disposed substantially adjacent or physically engages an inner surface of central bore 262 (i.e., ring 250 has an outer diameter substantially equal to or slightly less than an inner diameter of bore 262) to substantially align a central or longitudinal axis of running tool 260 with the central axis 155 of hanger 150. In the arrangement shown in FIG. 4, seals 228 of stab connectors 220 sealingly engage an inner surface of control line passages 264 to seal the connection formed between central bore 222 of connectors 220 and control line passages 264 from the surrounding environment. Thus, sealed signal communication (e.g., fluid communication, etc.) is provided between bore 222 of stab connectors 220 and control line passages 264 of running tool 260 when tool 260 is coupled with hanger 150. In this configuration, control signals may be communicated between control lines 268 of running tool 260 and the control lines 180 of hanger 150, where control lines 268 may be connected to, or in signal communication with actuatable or controllable components of a rig or platform of well system 10 while control lines 180 may be connected to, or in signal communication with other components of wellhead assembly 100 and/or well system 10. Thus, control signals may be communicated between the platform and the controllable components as hanger 150 is lowered towards and landed in wellhead housing 102.

Referring to FIGS. 5-10, FIGS. 5 and 6 illustrate an embodiment of a procedure for landing hanger 150 and control line sub 200 in an embodiment of wellhead housing 102. In the embodiment of FIGS. 5-10, wellhead housing 102 is generally cylindrical and includes a first or upper end 102A, a central bore or passage 104 extending from upper end 102A and defined by a generally cylindrical inner surface 106, and a generally cylindrical outer surface 108 extending from upper end 102A. Inner surface 106 of wellhead housing 102 includes a first or upper annular shoulder 110 at upper end 102A, a second or intermediate annular shoulder 112 disposed proximal to but axially spaced from upper shoulder 110, and a third or lower annular shoulder 114 axially spaced from shoulders 110 and 112. The outer surface 108 of wellhead housing 102 includes an annular shoulder 116 disposed proximal to upper end 102A. As shown particularly in FIGS. 5 and 6, when hanger 150 is disposed in wellhead housing 102 a central or longitudinal axis of wellhead housing 102 is substantially coaxial with central axis 155 of hanger 150.

Figure 5:
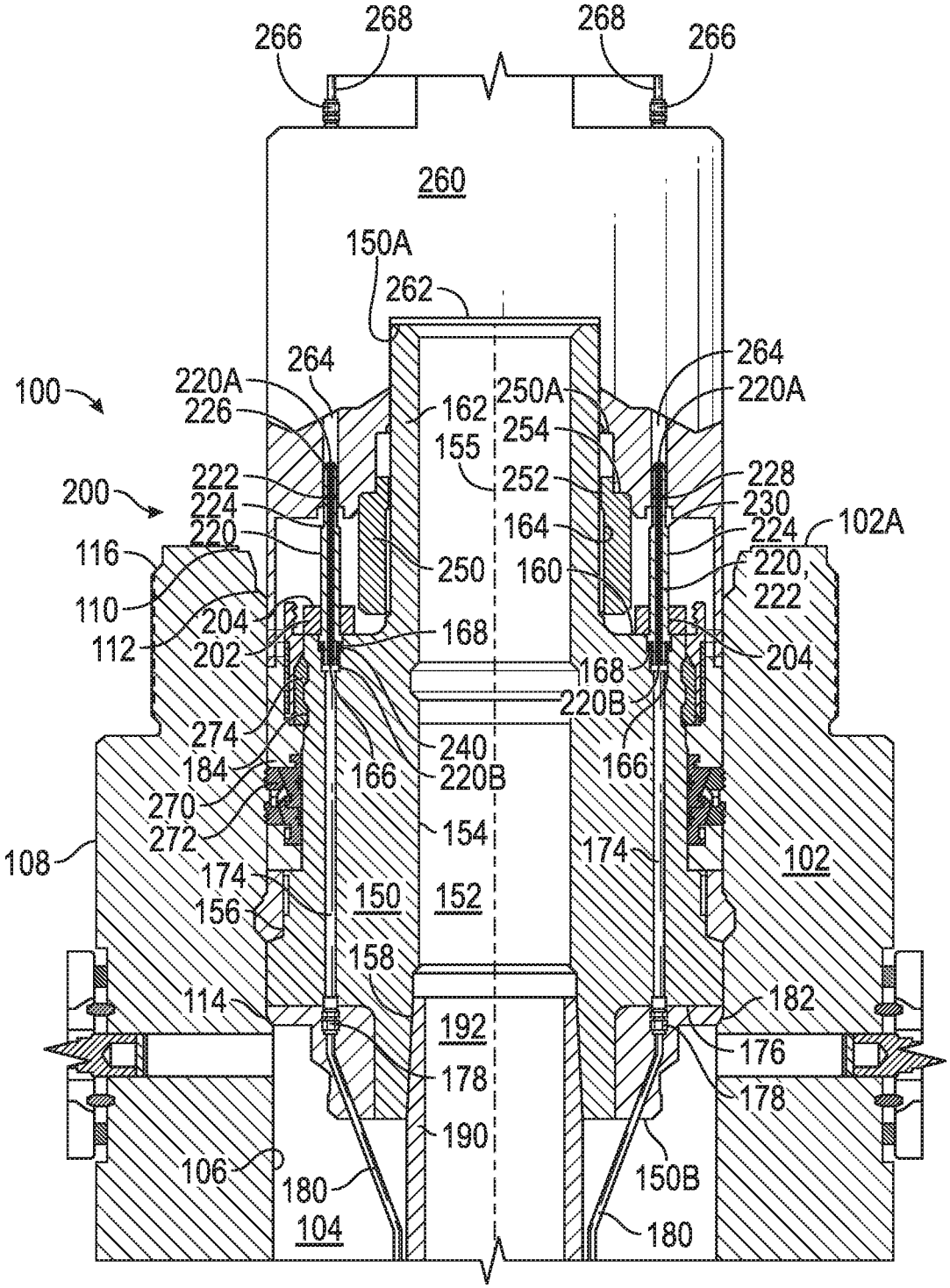
FIG. 5 is a partial cross-sectional view of an embodiment of a wellhead assembly of the well system of FIG. 1 shown in a first position in accordance with principles disclosed herein.

As shown particularly in FIG. 5, in an embodiment, running tool 260 lowers hanger 150, control line sub 200, and seal assembly 270 into central bore 104 of wellhead housing 102 until shoulder 182 of hanger 150 engages or lands against the lower shoulder 114 of wellhead housing 102, axially locating hanger 150 within bore 104 of wellhead housing 102. As shown particularly in FIG. 6, in an embodiment, once hanger 150 is landed in wellhead housing 102 running tool 260 is disconnected from seal assembly 270 and retrieved from the central bore 104 of wellhead housing 102. For instance, running tool 260 may be retrieved to the rig or platform from which tool 260 was deployed. In some embodiments, prior to disconnecting from hanger 150, running tool 260 actuates to energize hanger seals 272 of seal assemblies 270 (e.g., by applying a compressive force thereagainst, etc.) such that hanger seals 272 sealingly engage both the outer surface 156 of hanger 150 and the inner surface 106 of wellhead housing 102, thereby restricting fluid communication in the annulus formed between surfaces 156 and 106 of hanger 150 and housing 102, respectively; however, in other embodiments, hanger seals 272 may seal this annulus without needing to be energized. In still other embodiments, a separate running or actuation tool may be deployed to wellhead housing 102 following the retraction of tool 260 for actuating hanger seals 272.

Figure 6:
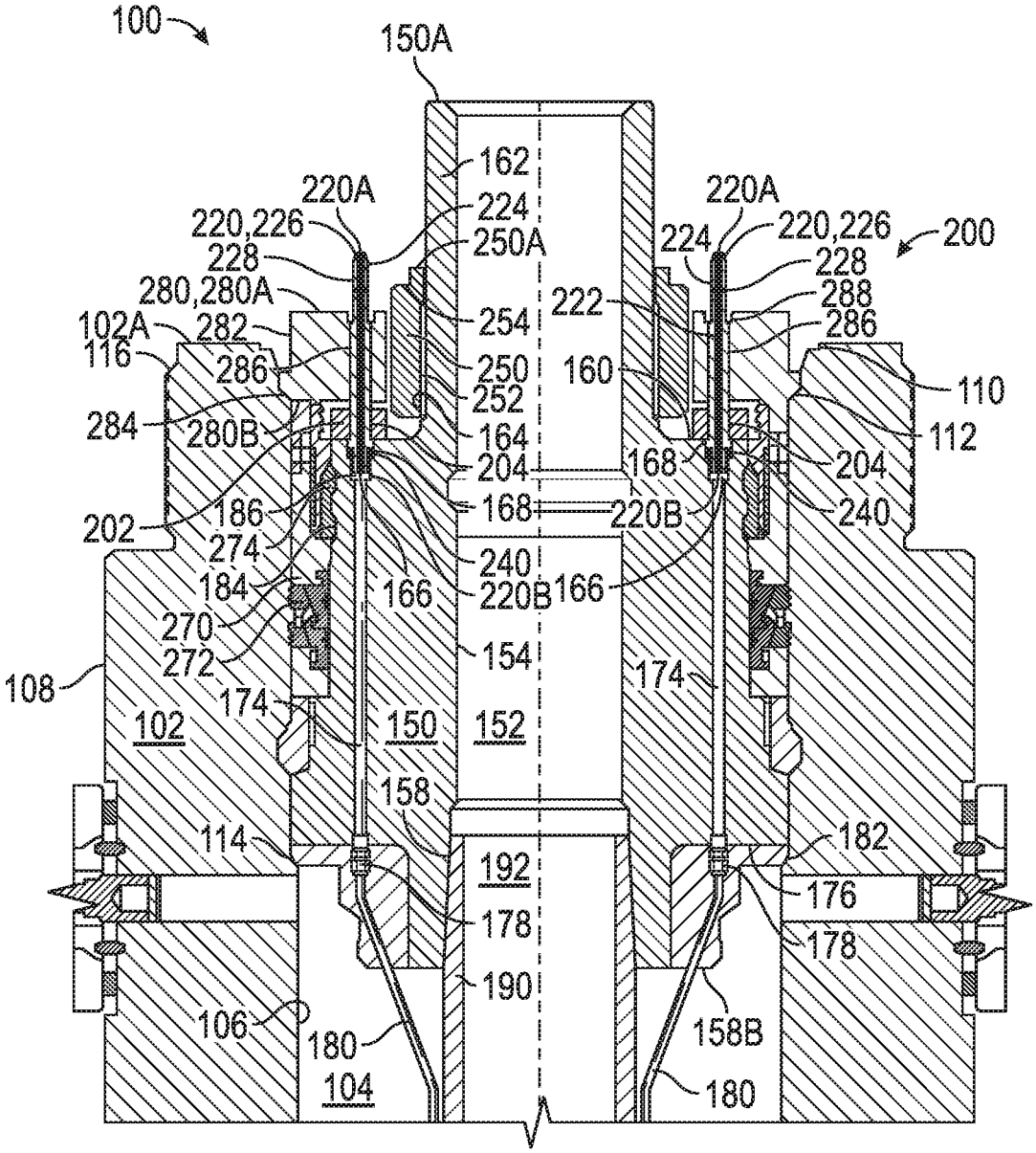
FIG. 6 is a partial cross-sectional view of the wellhead assembly of FIG. 5 shown in a second position.

As shown particularly in FIG. 6, in the embodiment of FIGS. 5-10, control line sub 200 further comprises an annular guide ring 280 that is lowered over the neck 162 of hanger 150 following the disconnection and retraction of running tool 260 from wellhead housing 102. Guide ring 280 has a first or upper end 280A, a second or lower end 280B, a central bore or passage defined by a generally cylindrical inner surface extending between ends 280A and 280B, and a generally cylindrical outer surface 282 extending between ends 280A and 280B. Outer surface 282 of guide ring 280 includes an annular shoulder 284 at lower end 280B. Additionally, guide ring 280 includes a plurality of circumferentially spaced bores or apertures 286 extending between ends 280A and 280B, where each bore 286 includes a counterbore or receptacle 288 (shown in FIG. 9) extending into bore 286 from upper end 280A, forming an annular shoulder 288S therein. Bores 286 are radially and circumferentially positioned in guide ring 280 such that stab connectors 220 may be slidably extended through bores 286 when guide ring 280 is lowered into wellhead housing 102. In this embodiment, when guide ring 280 is lowered into wellhead housing 102, stab connectors 220 extend through bores 286 and shoulder 284 of ring 280 engages or lands against intermediate shoulder 112 of wellhead housing 102, locating guide ring 280 in central bore 104 of housing 102. In some embodiments, guide ring 280 is lowered into position by hand, while in other embodiments, guide ring 280 may be lowered via a tool, such as a string or crane/lift conveyed running tool. When guide ring 280 is landed in wellhead housing 102, guide ring 280 is configured to provide physical support to stab connectors 220 to prevent connectors 220 from deforming when fully assembled in wellhead assembly 100, as will be discussed further herein.

Figure 7:
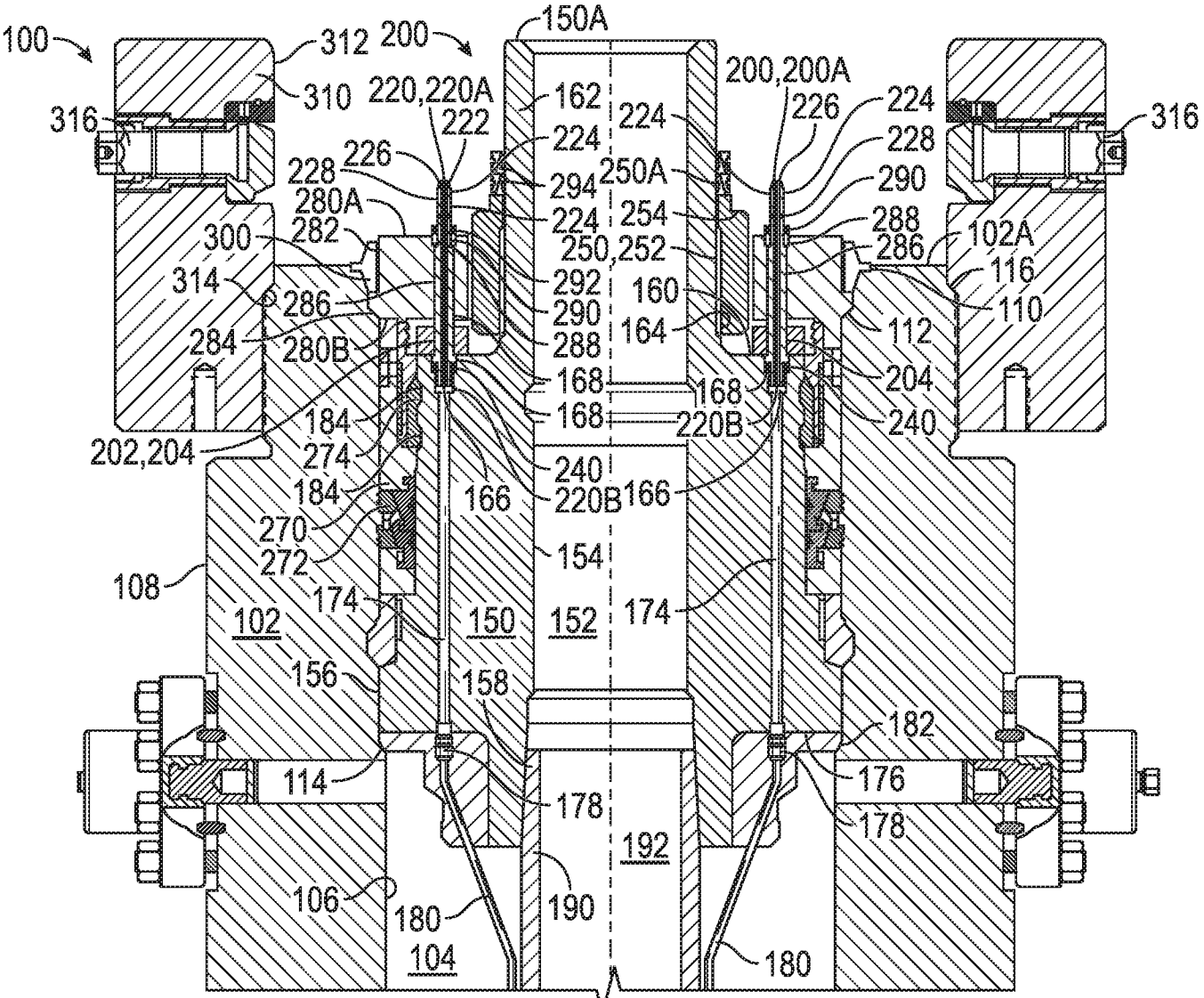
FIG. 7 is a partial cross-sectional view of the wellhead assembly of FIG. 5 shown in a third position.

As shown particularly in FIGS. 6 and 7, following the landing of guide ring 280 in wellhead housing 102, a plurality of annular spacers 290 are lowered over the upper end 220A of stab connectors 220 and landed against shoulder 288S of receptacles 288. Additionally, a plurality of annular guide ring seal assemblies 292 are lowered over the upper end 220A of stab connectors 220 and positioned against an upper end of spacers 290. In this embodiment, guide ring seal assemblies 292 are similar in configuration to support ring seal assemblies 240 discussed above and include an outer annular seal 292A and an inner annular seal 292B. In some embodiments, seals 292A and 292B of assembly 292 comprise Swagelok® seals (available from the Swagelok Company, Solon, Ohio). As shown particularly in FIG. 7, a pair of hanger neck seal assemblies 294 are lowered over the upper end 150A of hanger 150 and positioned or landed against the upper end 250A of load ring 250, where each hanger neck seal assembly 294 include radially inner and outer seals. As will be discussed further herein, unlike seal assemblies 240 and 292 discussed above, which are configured to energize in response to the application of an axially directed force applied thereto, hanger neck seal assembly 294 is configured to energize in response to the application of fluid pressure thereagainst. In some embodiments, the seals of hanger neck seal assembly 294 comprise suitable pressure assisted CANH™ seals (available from Cameron International Corporation, Houston, Tex.). Additionally, an annular seal ring 300 is lowered over guide ring 280 and landed against the upper shoulder 110 of hanger 150. In some embodiments, seal ring 300 comprises a metal seal ring 300, while in other embodiments, seal ring 300 may comprise varying materials.

As shown particularly in FIG. 7, in the embodiment of FIGS. 5-10, wellhead assembly 100 includes an annular connector 310 that includes a generally cylindrical inner surface 312 having an annular shoulder 314 disposed therein, and a plurality of circumferentially spaced engagement or coupling members 316. Either before or after the positioning of spacers 290, seal assemblies 292 and 294, and seal ring 300, annular connector 310 is lowered over wellhead housing 102 (by hand or using a string or crane/lift conveyed running tool) until shoulder 314 of connector 310 lands against shoulder 116 of wellhead housing 102. In some embodiments, the inner surface 312 of connector 310 may be releasably or threadably coupled to the outer surface 108 of wellhead housing 102.

Figure 8:
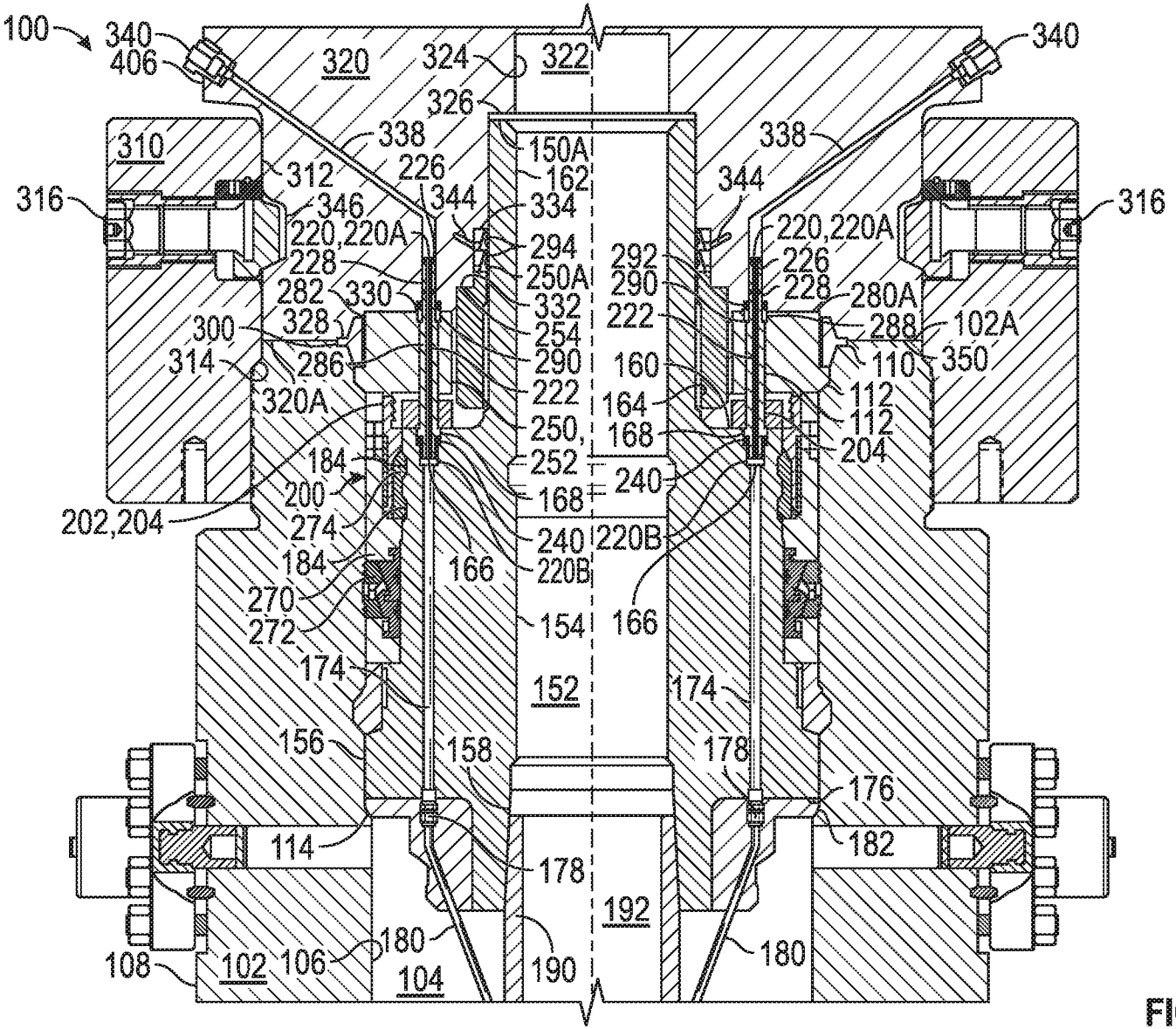
FIG. 8 is a partial cross-sectional view of the wellhead assembly of FIG. 5 shown in a fourth position.

As shown particularly in FIG. 8, wellhead assembly 100 includes a wellhead component or annular seal flange adapter 320 that lands against the upper end 102A of wellhead housing 102. Adapter 320 is generally configured to provide an interface between wellhead housing 102 and the tree 40 shown in FIG. 1. In some embodiments, wellhead housing 102 may comprise a tubing spool 102, with hanger 150 comprising a tubing hanger 150 and adapter 320 comprising a tubing head or tubing spool adapter 320. In the embodiment of FIGS. 5-10, adapter 320 is generally cylindrical and includes a first or lower end 320A, a central bore or passage 322 extending from lower end 320A and defined by a generally cylindrical inner surface 324, and a generally cylindrical outer surface 326 extending from lower end 320A. The inner surface 324 of adapter 320 includes a series of annular shoulders that reduce a diameter of inner surface 324 moving axially from lower end 320A. Particularly, inner surface 324 includes (moving upwards from lower end 320A) a first or lower annular shoulder 328 disposed at lower end 320A, a second or intermediate annular shoulder 330, a third or intermediate annular shoulder 332, a fourth or intermediate annular shoulder 334, and a fifth or upper annular shoulder 336. Central bore 322 of adapter 320 is configured to receive at least a portion of hanger 150, and thus, when adapter 320 is landed against wellhead housing 102 the central or longitudinal axis of adapter 320 is substantially coaxial with central axis 155 of hanger 150.

Additionally, adapter 320 includes a plurality of circumferentially spaced control line passages 338. Each control line passage 338 of adapter extends between intermediate shoulder 330 and outer surface 326, and includes a control line fitting 340 disposed at the terminal end of passage 338 at the outer surface 326. Each control line passage 338 also includes a counterbore or aperture 340 (shown in FIG. 9) extending therein from intermediate shoulder 330, forming an annular shoulder 340S in passage 338. Control line passages 338 are radially and circumferentially positioned in adapter 320 such that stab connectors 220 of control line sub 200 may be slidably received therein when adapter 320 is landed against wellhead housing 102. Adapter 320 also includes one or more test ports 344 (shown partially in FIG. 8) extending from the portion of inner surface 324 disposed between intermediate annular shoulders 332 and 334. In this embodiment, the outer surface 326 of adapter 320 includes an annular locking or coupling groove 346 disposed therein.

In the embodiment of FIGS. 5-10, seal flange adapter 320 is axially lowered (by hand or using a running tool conveyed by a conveyance string or a crane/lift, etc.) towards wellhead housing 102 until lower end 320A lands against the upper end 102A of wellhead housing 102. As adapter 320 is lowered into position, the upper end 150A and neck 162 of hanger 150 are stabbed into central bore 322 of adapter 320 while stab connectors 220 are stabbed into control line passages 338. As stab connectors 220 are stabbed into control line passages 338, the seal 228 of each stab connector 220 sealingly engages the inner surface of the passage 338 in which the connector 220 is received. Frustoconical profiles 226 of stab connectors 220 assist in aligning stab connectors 220 with their corresponding control line passages 338 of adapter 320 as connectors 220 are stabbed therein. Additionally, the strength of stab connectors 220, as well as the physical support provided by guide ring 280 to stab connectors 220, prevents or limits the amount of deflection of stab connectors 220 in response to engagement between stab connectors 220 and the inner surface of control line passages 338 as connectors 220 are stabbed therein. The limited deflection of stab connectors 220 assists in aligning connectors 220 with their corresponding control line passages 338 during the stabbing process.

In the embodiment of FIGS. 5-10, each guide ring seal assembly 292, and at least a portion of each spacer 290, is received in the aperture 342 of a corresponding control line passage 338. In response to adapter 320 landing against wellhead housing 102, each guide ring seal assembly 292 is compressed between its corresponding spacer 290 and the annular shoulder 342S of the receptacle 342 in which the assembly 292 is received, thereby energizing each seal assembly 292. Particularly, an angled or inclined inner surface of outer seal 292A is wedged into sealing engagement with the inner surface of its respective control line passage 338 while the outer surface of inner seal 292B is wedged into sealing engagement with the outer surface 224 of its respective stab connector 220. In this arrangement, the sealing engagement provided by guide ring seal assemblies 292 and the seal 228 of stab connectors 220 seals the connection formed between each corresponding control line passage 338 of adapter 320 and central bore 222 of stab connector 220 from the surrounding environment.

Additionally, once seal flange adapter 320 is landed against wellhead housing 102, seal ring 300 sealingly engages the lower shoulder 328 of adapter 320 and the upper shoulder 110 of wellhead housing 102, thereby restricting fluid communication between an annular chamber 348 formed between adapter 320 and wellhead housing 102 and the annular engagement interface 350 formed between the lower end 320A of adapter 320 and the upper end 102A of wellhead housing 102. Further, the landing of adapter 320 against wellhead housing 102 causes the upper end 250A of load ring 250 and intermediate annular shoulder 334 of adapter 320 to compress against hanger neck seal assemblies 294 disposed therebetween. Similar to the operation of guide ring seal assemblies 292 described above, compression of hanger neck seal assemblies 294 energizes seal assemblies 294, causing an outer annular seal of each assembly 294 to sealingly engage the inner surface 324 of adapter 320 and an inner annular seal of each assembly 294 to sealingly engage the outer surface 156 of hanger neck 162. Sealing engagement provided by hanger neck seal assemblies 294 restricts fluid communication between annular chamber 348 and the portion of the central bore 322 of adapter 320 disposed above seal assemblies 294 (i.e., the portion extending axially upwards from intermediate annular shoulder 334). In some embodiments, the axial position of load ring 250 along neck 162 of hanger 150 may be adjusted to adjust the axial position of hanger neck seal assembly 294 thereon. For instance, if a greater degree of compression of seal assembly is desired, the position of load ring 250 may be adjusted by rotating load ring 250 about neck 162 to displace ring 250 axially towards upper end 150A of hanger 150. Conversely, if less compression of hanger neck seal assembly 294 is desired, then load ring 250 may be rotated in the opposite direction to displace ring 250 towards upper shoulder 160 of hanger 150.

In the embodiment of FIGS. 5-10, following landing of seal flange adapter 320 against wellhead housing 102, engagement members 316 of connector 310 may be actuated into a radially inwards or locked position where at least a portion of each engagement member 316 is received in the locking groove 346 of adapter 320, thereby locking seal flange adapter 320 to wellhead housing 102. Additionally, in some embodiments, test ports 344 of adapter 320 may be used to test the seal effectuated by hanger neck seal assemblies seal assemblies 294. For instance, hydraulic pressure may be applied and then sealed or isolated in test ports 344. Fluid pressure in test ports 344 may then be monitored to determine if hanger neck seal assemblies 294 are able to prevent the pressurized fluid disposed in ports 344 from leaking therefrom. Similarly, fluid pressure may be applied to a test port 352 extending from lower end 320A of adapter 320 to determine the seal integrity provided by hanger neck seal assemblies 294, seal ring 300, guide ring seal assemblies 292, support ring seal assemblies 240, and hanger seals 272. In other embodiments, test port 352 for pressure testing seals 240, 272, 292, 294, and 300 may be located in wellhead housing 102.

Figure 11:
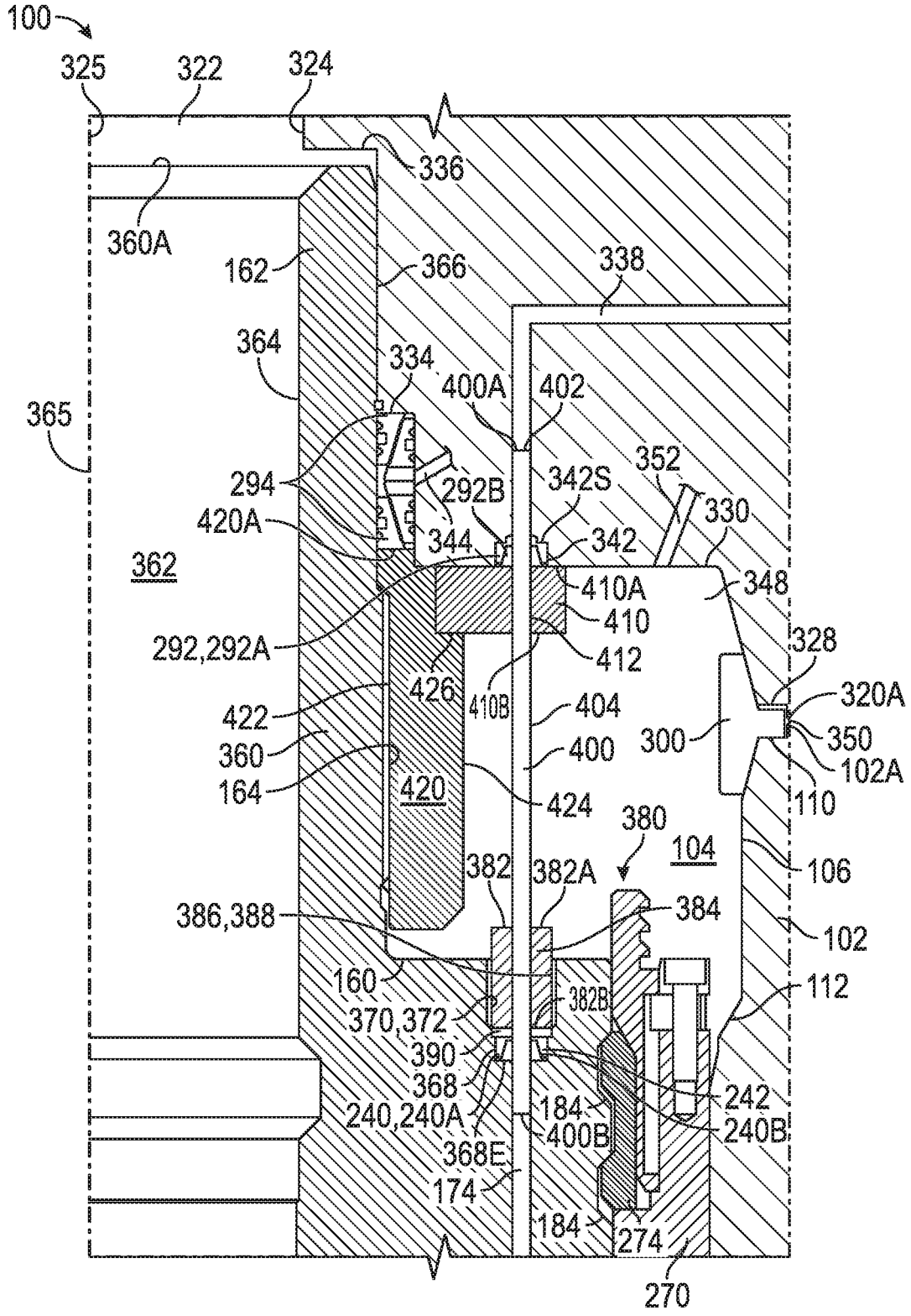
FIG. 11 is a cross-sectional view of another embodiment of a control line sub assembly of the well system of FIG. 1 in accordance with principles disclosed herein.

Referring to FIGS. 1 and 11, another embodiment of a tubing and/or casing hanger 360 and a control line sub 380 of wellhead assembly 100 of the well system 10 of FIG. 1 are shown in FIG. 11. Hanger 500 and control line sub 380 have features in common with the hanger 150 and control line sub 200 described above, and shared features are labeled similarly. In the embodiment of FIG. 11, hanger 360 has a central or longitudinal axis 365 and includes a central bore or passage 362 defined by a generally cylindrical inner surface 364 extending from a first or upper end 360A of hanger 360, and a generally cylindrical outer surface 366 extending from upper end 360A. The upper shoulder 160 of hanger 360 includes a plurality of circumferentially spaced apertures or bores 368 extending therein. In the embodiment of FIG. 11, each bore 368 includes a counterbore 370 extending therein from upper shoulder 160, where counterbore 370 has a releasable or threaded connector 372 disposed on an inner surface thereof. A control line passage 174 of hanger 360 extends from a terminal end 368E of each bore 368, thereby providing signal communication (e.g., fluid communication, etc.) between each control line passage 174 and corresponding bore 368.

FIG. 11 illustrates hanger 360 after it has been landed within wellhead housing 102, where hanger 360 may be landed in wellhead housing 102 using a running tool or via other means known in the art. In the embodiment shown in FIG. 11, control line sub 200 generally includes a plurality of circumferentially spaced support or torque rings 382, a plurality of circumferentially spaced tubular members or control lines 400, and a guide ring 410. Each torque ring 382 of control line sub 380 is generally cylindrical and has a first or upper end 382A, a second or lower end 382B, a central bore or passage 384 extending between ends 382A and 382B, and a generally cylindrical outer surface 386 extending between ends 382A and 382B. The outer surface 386 of each torque ring 382 includes a releasable or threaded connector 388 disposed therein configured to releasably or threadably couple with the connector 372 of hanger 360. Although in this embodiment connectors 372 and 388 of hanger 360 and torque rings 382, respectively, are described as threaded connectors, in other embodiments, connectors 372 and 388 may comprise other releasable connectors known in the art.

In the embodiment of FIG. 11, control line sub 380 additionally includes a plurality of circumferentially spaced spacer rings or washers 390. Unlike control line sub 200 discussed above, the control line sub 380 is coupled with hanger 360 following the landing of hanger 360 in wellhead housing 102. Particularly, when control line sub 380 is coupled with hanger 360, a seal assembly 240 is disposed in each bore 368 along with a spacer ring 390, with the inner seal 240B engaging the terminal end 368E of bore 368 and the outer seal 240A engaging a lower end of the spacer rings 390. Prior to the insertion of torque rings 382 into bores 368, each torque ring 382 is coupled with a control line 400. In the embodiment of FIG. 11, each control line 400 is generally cylindrical and has a first or upper end 400A, a second or lower end 400B, a central bore or passage 402 extending between ends 400A and 400B, and a generally cylindrical outer surface 404 extending between ends 400A and 400B. Unlike stab connectors 220 of the control line sub 200 discussed above, in this embodiment, each control line 400 comprises flexible tubing configured to allow for the deflection of lines 400 during the assembly of control line sub 380 with hanger 360 and seal flange adapter 320. Prior to inserting torque ring 382 in its corresponding bore 368 of hanger 360, the lower end 400B of a control line 400 is inserted through the central bore 384 of the torque ring 382.

Following the insertion of seal assemblies 240 and spacer rings 390 in bores 368 of hanger 360, a torque ring 382 may be coupled with the each bore 368, where the application of torque to torque ring 382 may be used to apply an axially directed force (i.e., a force in a direction parallel with central axis 365 of hanger 360) against the spacer ring 390 to compress and energize the seals of seal assembly 240. Particularly, torque applied to torque ring 382 is translated into an axially directed force against the upper end of outer seal 240A, which acts against the inclined or angled interface 242 formed between seals 240A and 240B to force outer seal 240A into sealing engagement with an inner surface of bore 368 and inner seal 240B into sealing engagement against the outer surface 404 of control line 400. The sealing engagement provided by seal assembly 240 seals the fluid connection formed between control line passage 174 of hanger 360 and the central bore 402 of the control line 400. In some embodiments, the engagement between inner seal 240B and the outer surface 404 of control line 400 also couples control line 400 with seal assembly 240 such that relative axial movement between control line 400 and hanger 360 is restricted.

In the embodiment of FIG. 11, wellhead assembly 100 also includes a load ring 420 in lieu of the previously discussed load ring 250, where load ring 420 has features in common with ring 250, and shared features are labeled similarly. Load ring 420 is generally cylindrical and includes a first or upper end 420A, a second or lower end 420B, a central bore or passage defined by a generally cylindrical inner surface 422 extending between ends 420A and 420B, and a generally cylindrical outer surface 424 extending between ends 420A and 420B. Similar to load ring 250 discussed above, load ring 420 may be threadably coupled with neck 162 of hanger 360 prior to the landing of hanger 360 in wellhead housing 102. In the embodiment of FIG. 11, the outer surface 424 includes an upward facing annular shoulder 426 located proximal to, but axially spaced from upper end 420A.

In the embodiment of FIG. 11, following the coupling of control line sub 380 with hanger 360 with hanger 360 located in wellhead housing 102, guide ring 410 may be landed over the neck 162 of hanger 360. Particularly, guide ring 410 is generally annular in shape and includes a first or upper end 410A and a second or lower end 410B, where lower end 410B lands against and engages the shoulder 426 of load ring 420 to physically support guide ring 410 and axially locate ring 410 relative hanger 360. In the arrangement shown in FIG. 11, guide ring 410 comprises an outer guide ring 410 while load ring 420 comprises an inner load ring 420, where the central or longitudinal axis of each ring 410 and 420 is disposed substantially coaxial with central axis 365 of hanger 360. In the embodiment of FIG. 11, outer guide ring 410 includes a plurality of circumferentially spaced bores 412 extending between upper end 410A and lower end 410B, where bores 412 are radially and circumferentially positioned in outer guide ring 410 such that the upper ends 400A of control lines 400 are permitted to extend through bores 412 when outer guide ring 410 is lowered into position over the neck 162 of hanger 360.

In the embodiment of FIG. 11, prior to the lowering of seal flange 320 over hanger 360 and control line sub 380, a guide ring seal assembly 292 is lowered over the upper end 400A of each control line tubing 400 and landed against the upper end 410A of guide ring 410, and hanger neck seal assemblies 294 are lowered over the neck 162 of hanger 360 and landed against the upper end 420A of load ring 420. In some embodiments, the axial position of load ring 420 relative hanger 360 may be adjusted to control the amount of compression or compressive force applied to seal assemblies 294 following the landing of seal flange adapter 320 over hanger 360 and against wellhead housing 102.

In the embodiment of FIG. 11, with guide ring seal assemblies 292 positioned about each control line 400 and hanger neck seal assemblies 294 positioned about neck 162 of hanger 360, the lower end 320A of seal flange adapter 320 is landed against the upper end 102A of wellhead housing 102 and coupled thereto (e.g., via connector 310, etc.). As adapter 320 is landed, the upper ends 400A of control lines 400 are inserted in and extend through control line passages 338 of adapter 320. The flexibility provided by control lines 400 permit less tight or precise tolerances in the position of adapter 320 relative control line sub 200 and hanger 360. Specifically, in the event of slight radial misalignment between adapter 320 and hanger 360 (e.g., where a central axis 325 of adapter 320 is parallel with, but radially spaced from the central axis 365 of hanger 360), each control line 400 is configured to flex or deflect to allow a sealed fluid connection to be formed between each control line passage 338 of adapter 320 and a corresponding control line passage 174 of hanger 360. In other words, the upper ends 400A of control lines 400 are configured to deflect and radially misalign with the corresponding lower ends 400B of lines 400 to provide signal communication (e.g., fluid communication, etc.) between control line passages 338 and 174, respectively. Following the landing of adapter 320 against wellhead housing 102, the annular chamber 348 formed therein may be pressure tested via test port 352 and hanger neck seal assemblies 294 may be pressure tested via test port 344 as discussed above with respect to hanger 150 and control line sub 200.

Figure 12:
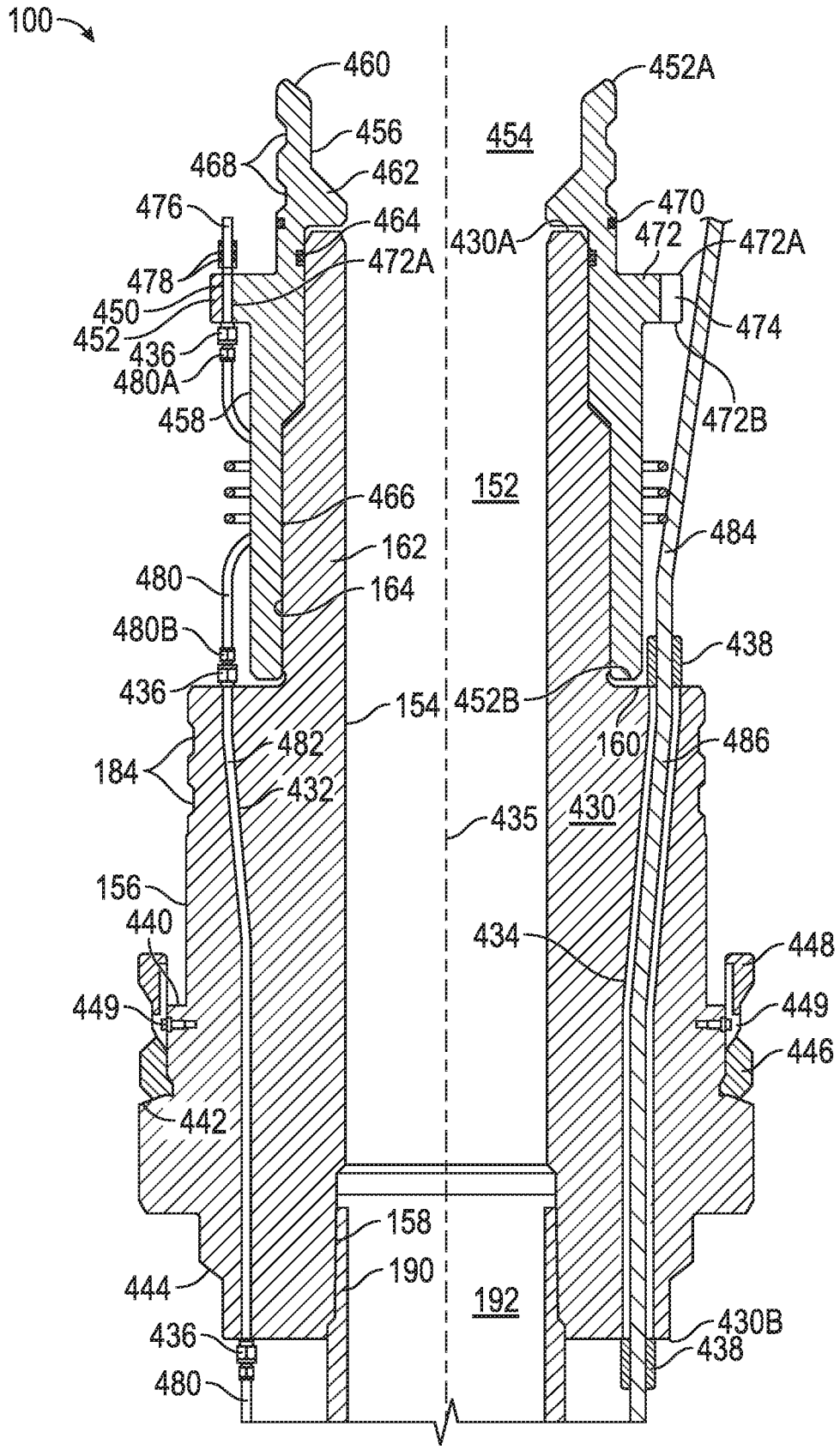
FIG. 12 is a cross-sectional view of an embodiment of a control line sub assembly and a hanger of the well system of FIG. 1 in accordance with principles disclosed herein.

Referring to FIGS. 1 and 12, another embodiment of a tubing or casing hanger 430 and a control line assembly 450 of the wellhead assembly 100 of FIG. 1 are shown in FIG. 2. Hanger 430 has features in common with the hanger 150 described above, and shared features are labeled similarly. In the embodiment shown in FIG. 12, hanger 430 has a central or longitudinal axis 435 and generally includes a first or upper end 430A, and a second or lower end 430B. Hanger 430 includes a first control line passage or bore 432 and a second control line passage or bore 434 spaced circumferentially from first control line passage 432. First and second control line passages 432 and 434 each extend between upper shoulder 160 and lower end 430B. In some embodiments, hanger 430 may include varying numbers of first control line passages 432 and/or second control line passages 434. In some embodiments, hanger 430 may only include either one or more first control line passage 432, or one or more second control line passages 434. In the embodiment shown in FIG. 12, each terminal end of first control line passage 432 receives a control line connector or fitting 436 while each terminal end of second control line passage 434 receives a control line penetrator 438.

In this embodiment, the outer surface 156 of hanger 430 additionally includes a second or intermediate annular shoulder 440 located axially between upper shoulder 160 and lower end 430B, a third or intermediate annular shoulder 442 located axially between intermediate shoulder 440 and lower end 430B, and a fourth or lower shoulder 444 located axially between intermediate shoulder 442 and lower end 430B. Intermediate shoulders 440 and 442 each face upper end 430A with intermediate shoulder 442 having a greater diameter than shoulder 440. Lower shoulder 444 faces lower end 430B and includes an angled or conical landing profile configured to land against a corresponding or mating landing profile or locking groove 124 disposed in a wellhead housing 102' to axially locate hanger 430 therein during the assembly of wellhead assembly 100. Wellhead housing 102' (shown in FIGS. 19-24) is similar in configuration to wellhead housing 102 shown in FIGS. 5-11 except that it includes locking groove 124. In the embodiment shown in FIG. 12, an annular hanger locking member or lock ring 446 is disposed against intermediate shoulder 442 while an annular hanger energizing member or ring 448 is disposed directly adjacent and axially above (i.e., towards upper end 430A of hanger 430) hanger lock ring 446, where hanger energizing ring 448 is coupled to the outer surface 156 of hanger 430 via a plurality of circumferentially spaced shear members or pins 449.

Control line assembly 450 of wellhead assembly 100 is generally configured to provide for the transmission of control signals between a rig or other source of control signals of well system 10, and tools or other components suspended from hanger 430 during and after the installation of hanger 430 in the wellhead housing 102' of wellhead assembly 100. In this embodiment, control line assembly 450 generally includes a control line sub or mandrel 452, a pair of first control lines 480, and a second control line 484. In some embodiments, control line assembly 450 may include varying numbers of circumferentially spaced first control lines 480 and second control lines 484. In some embodiments, control line assembly 450 may only include either one or more first control lines 480, or one or more second control lines 484. Control line mandrel 452 is generally cylindrical having a central or longitudinal axis disposed coaxially with central axis 435 of hanger 430 when mandrel 452 is coupled therewith. Control line mandrel 452 includes a first or upper end 452A, a second or lower end 452B, a central bore or passage 454 extending between ends 452A, 452B, and defined by a generally cylindrical inner surface 456, and a generally cylindrical outer surface 458.

In the embodiment shown in FIG. 12, the inner surface 456 of control line mandrel 452 includes an annular angled or conical landing shoulder 460 disposed at upper end 452A and an annular flange 462 axially spaced from landing shoulder 460. Flange 462 includes an inner diameter substantially the same as a diameter of the inner surface 154 of hanger 430 to thereby protect the upper end 430A of hanger 430 from collision with tools or other equipment extended through bore 152 of hanger 430 when mandrel 450 is coupled with hanger 430. Additionally, the inner surface 456 of control line mandrel 452 includes an annular seal 464 disposed therein and a releasable connector 466. Seal 464 is configured to sealingly engage the outer surface 156 of the neck 162 of hanger 430 when mandrel 450 is coupled with hanger 430. Releasable connector 466 is configured to releasably couple with connector 164 of hanger 430. In some embodiments, connector 466 comprises a threaded connector configured to threadably couple with connector 164 of hanger 430.

In the embodiment shown in FIG. 12, the outer surface 458 of control line mandrel 452 includes a pair of axially spaced, annular engagement or locking grooves 468 disposed therein and located proximal upper end 452A, an annular seal 470 disposed therein, and an annular flange 472, where seal 470 is located axially between locking grooves 468 and flange 472. Flange 472 includes a first or upper end 472A facing upper end 452A, and an axially spaced second or lower end 472B facing lower end 452B. In the embodiment shown in FIG. 12, a stab connector 476 is coupled to the upper end 472A of flange 472 while a control line connector 436 is coupled to the lower end 472B thereof. Stab connector includes a pair of axially spaced annular seals 478 disposed in an outer surface thereof. Stab connector 476 is circumferentially aligned with the control line connector 436 coupled with flange 472 where a control line passage 472P extends through flange 472 to provide fluid communication between stab connector 476 and connector 436. Further, flange 472 of control line mandrel 452 includes a pocket or receptacle 474 extending into the outer surface 458 thereof for at least partially receiving second control line 484 during the process of installing hanger 430 in wellhead housing 102', as will be discussed further herein.

In the embodiment shown in FIG. 12, an upper first control line 480 includes a first terminal end 480A coupled to the control line connector 436 of flange 472 and a second terminal end 480B coupled to the control line connector 436 coupled to the upper shoulder 160 of hanger 430. Additionally, a lower first control line 480 includes a first terminal end 480A coupled to the control line connector 436 coupled to the lower end 430B of hanger 430. In this configuration, communication, such as fluid communication, is provided through a first signal pathway 482 extending between stab connector 476 and the lower first control line 480 via the upper first control line 480 and first control line passage 432 extending through hanger 430. In some embodiments, first signal pathway 482 extends between a control signal source disposed at a rig or other location of well system 10, and a control signal destination, such a controllable valve or other tool suspended from hanger 430. Thus, while communication may be provided between stab connector 476 and the lower first control line 480, the signal pathway 482 extending therebetween includes multiple discontinuous first control lines 480 (i.e., pathway 482 does not comprise a single, continuous control line 480) separated by first control line passage 432.

Unlike the pair of first control lines 480, second control line 484 extends continuously through second control line passage 434, where penetrators 438 act to seal passage 434 from the surrounding environment. Thus, second control line 484 is configured to provide a second control signal pathway 486 comprising a single, continuous second control line 484 extending substantially between the signal source and the signal destination of second signal pathway 486. In this manner, second control line 484 does not rely on passages extending between terminating ends of multiple control lines for conducting control signals along second control signal pathway 486. In the embodiment shown in FIG. 12, first control lines 480 comprise hydraulic control lines configured to transmit fluid flow or pressure while second control line 484 comprises an electric control line configured to transmit electric control signals; however, in other embodiments, control lines 480 and 484 may be configured to convey or transmit various forms of control signals including hydraulic, pneumatic, electric, optical, acoustic, and the like.

Figure 13:
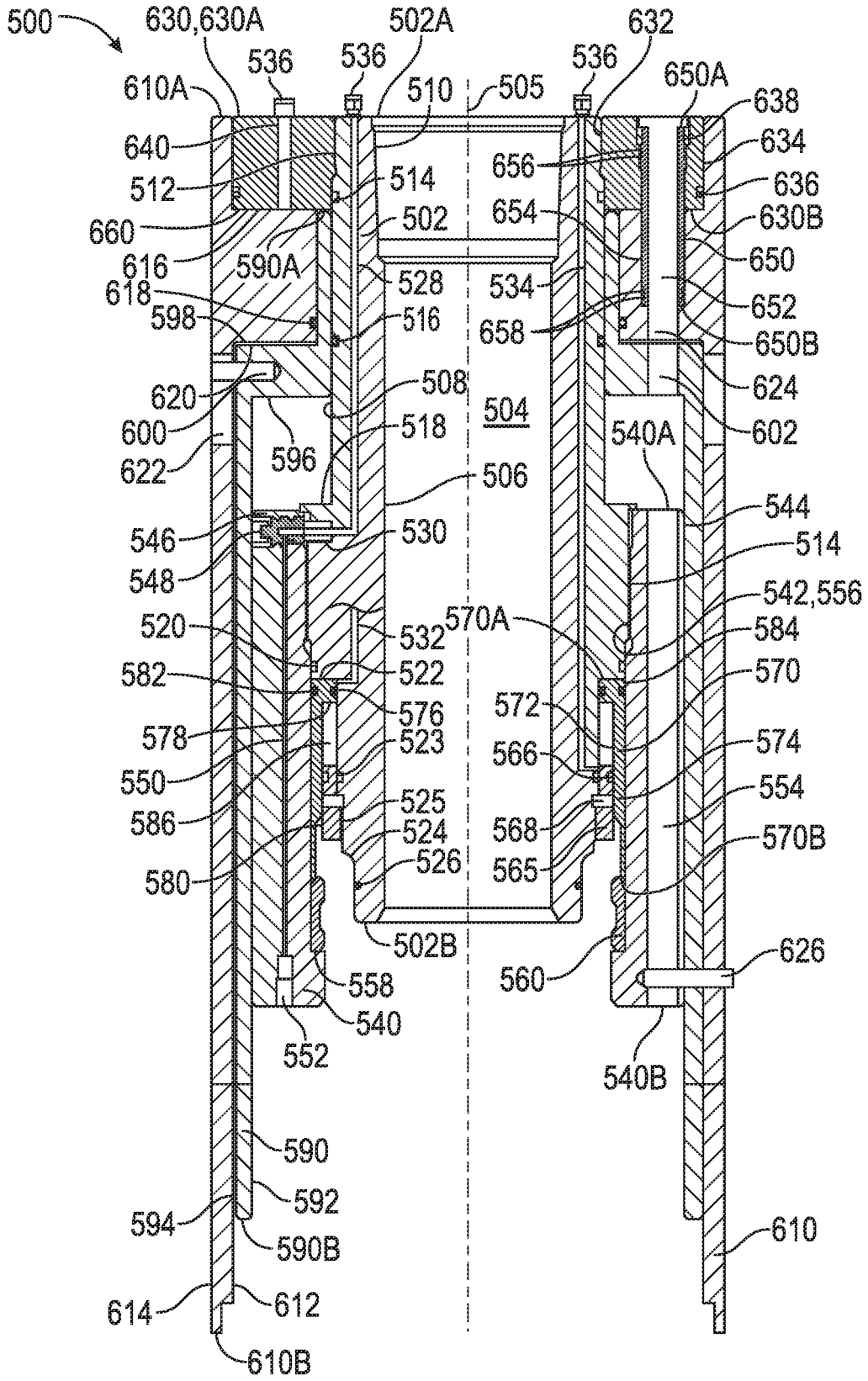
FIG. 13 is a cross-sectional view of an embodiment of a running tool of the well system of FIG. 1 and the control line sub assembly and hanger of FIG. 12 in accordance with principles disclosed herein.

Referring to FIGS. 1 and 13, an embodiment of a running tool 500 configured to install hanger 430 in wellhead housing 102' is shown in FIG. 13. Particularly, running tool 500 comprises an embodiment of the running tool 20 of well system 10 shown schematically in FIG. 1. In the embodiment shown in FIG. 13, running tool 500 has a central or longitudinal axis 505 disposed coaxially with central axis 435 of hanger 430 when tool 500 is coupled therewith and generally includes an inner mandrel 502, a carrier sleeve 540, a first or lower retainer ring 565, an actuation or energizing ring 570, an inner sleeve 590, an outer sleeve 610, a second or upper retaining ring 630, and a penetrator 650.

The inner mandrel 502 of running tool 500 is generally cylindrical and has a first or upper end 502A, a second or lower end 502B, a central bore or passage 504 defined by a generally cylindrical inner surface 506 extending between ends 502A and 502B, and a generally cylindrical outer surface 508 extending between ends 502A and 502B. The inner surface 506 includes a releasable or threaded connector 510 axially located proximal upper end 502A for releasably coupling with a tool or string (e.g., conveyance string 22 shown in FIG. 1, etc.) from which running tool 500 is suspended from during operation. In the embodiment shown in FIG. 13, the outer surface 508 of inner mandrel 502 includes a first or upper releasable or threaded connector 512 axially located proximal upper end 502A, a first or upper annular seal 514 disposed therein, a second or intermediate annular seal 516 axially spaced from upper seal 514, a first or upper annular shoulder 518 facing upper end 502A, a second or intermediate releasable or threaded connector 519, a third or lower annular seal 520 disposed therein, a second or intermediate annular shoulder 522 facing lower end 502B, a third or intermediate annular seal 523 disposed therein, a third or lower releasable or threaded connector 525, a third or lower annular shoulder 524 facing lower end 502B, and a fourth or lower annular seal 526 disposed therein and axially located proximal lower end 502B.

In the embodiment shown in FIG. 13, inner mandrel 502 includes a control line passage 528 extending between upper end 502A and a receptacle 530 that extends into the outer surface 508 of mandrel 502, where receptacle 530 is axially located proximal to but below upper shoulder 518. Inner mandrel 502 additionally includes a first control or actuation passage 532 and a second control or actuation passage 534, where passages 528, 532, and 534 are each circumferentially spaced from each other (first actuation passage 532 is partially shown in FIG. 13 for convenience). First actuation passage 532 has a first terminal end at upper end 502A (upper end of passage 532 not shown in FIG. 13) and a second terminal end extending through outer surface 508, where the second end of passage 532 is axially located adjacent to intermediate shoulder 522. Second actuation passage 534 has a first terminal end at upper end 502A and a second terminal end extending through outer surface 508, where the second end of passage 534 is axially spaced from intermediate shoulder 522. The upper terminal ends of passages 528, 532, and 534 each receive a control line connector or fitting 536 to couple with corresponding control lines (not shown) extending therefrom for transmitting control signals to passages 528, 532, and 534.

Carrier ring 540 of running tool 500 is generally configured to releasably couple the control line assembly 450 and hanger 430 coupled therewith with running tool 500. In the embodiment shown in FIG. 13, carrier ring 540 is generally cylindrical and has a first or upper end 540A, a second or lower end 540B, a central bore or passage defined by a generally cylindrical inner surface 542 extending between ends 540A and 540B, and a generally cylindrical outer surface 504 extending between ends 540A and 540B. Carrier ring 540 includes a first or upper receptacle 546 extending radially between surfaces 542, 544, and axially located proximal upper end 540A. In the embodiment shown in FIG. 13, upper receptacle 546 of carrier ring 540 is axially and circumferentially aligned with receptacle 530 of inner mandrel 502. In this arrangement, a control line connector or fitting 548 is disposed in both receptacles 546 and 530 of carrier ring 530 and inner mandrel 502, respectively, to provide a sealed connection therebetween via a plurality of annular seals disposed on an outer surface of connector 548.

Carrier ring 540 additionally includes a first control line passage 550 extending between upper receptacle 546 and a second or lower receptacle 552 that extends axially into the lower end 540B of carrier ring 540. Carrier ring 540 also includes a second control line passage 554 circumferentially spaced from first control line passage 550 and extending axially between upper end 540A and lower end 540B. In the embodiment shown in FIG. 13, the inner surface 542 of carrier ring 540 includes a releasable or threaded connector 550 and an annular shoulder 558 facing upper end 540A and axially located proximal lower end 540B. Releasable connector 556 is configured to releasably or threadably couple with the intermediate connector 519 of inner mandrel 502. Annular shoulder 558 of ring 540 supports or receives an annular running tool engagement or lock ring 560 disposed thereagainst, where running tool lock ring 560 is configured to releasably lock against control line assembly 450, as will be discussed further herein.

The lower retainer ring 565 of running tool 500 is generally cylindrical and is releasably coupled to the outer surface 508 of inner mandrel 502 via lower connector 525 of inner mandrel 502. In the embodiment shown in FIG. 13, lower retainer ring 565 includes an annular seal disposed in a cylindrical outer surface of ring 565 and an anti-rotation key 568 that extends radially through lower retainer ring 565 and into the inner surface 508 of inner mandrel 502 to restrict relative rotation between lower retainer ring 565 and inner mandrel 502. In this configuration, intermediate annular seal 523 of inner mandrel 502 sealingly engages a cylindrical inner surface of lower retainer ring 565. Although in the embodiment shown in FIG. 13 inner mandrel 502, carrier ring 540, and lower retainer ring 565 comprise separate and distinct components releasably coupled together, in other embodiments, mandrel 502 and rings 540 and 565 may comprise a single, unitary or monolithic component.

Energizing ring 570 of running tool 500 is configured to axially translate or slide relative inner mandrel 502, carrier ring 540, and lower retainer ring 565 to actuate running tool lock ring 560 from a first or radially outer unlocked position and a second or radially inner locked position, as will be discussed further herein. In the embodiment shown in FIG. 13, energizing ring 570 is generally cylindrical and includes a first or upper end 570A, a second or lower end 570B, a central bore or passage defined by a generally cylindrical inner surface 572 extending between ends 570A and 570B, and a generally cylindrical outer surface 574 extending between ends 570A and 570B that is in sliding engagement with the outer surface of lower retainer ring 565 and the outer surface 508 of inner mandrel 502.

In the embodiment shown in FIG. 13, the inner surface 572 of energizing ring 570 includes an inner annular seal disposed therein and axially located proximal upper end 570A, a first or upper annular shoulder 578 facing lower end 570B and axially located proximal to but disposed below (i.e., towards lower end 570B) inner seal 576, and a second or lower annular shoulder 580 axially spaced from upper shoulder 578. The outer surface 574 of energizing ring 570 includes an annular outer seal 582 disposed proximal upper end 570A. In the configuration shown in FIG. 13, a first or upper annular chamber 584 is formed between intermediate shoulder 522 of inner mandrel 502 and the upper end 570A of energizing ring 570. Additionally, a second or lower annular chamber 586 is formed between upper shoulder 578 of energizing ring 570 and the upper end of lower retainer ring 565.

In the embodiment shown in FIG. 13, upper chamber 584 is in fluid communication with first actuation passage 532 of inner mandrel 502 but is otherwise sealed off from the surrounding environment (including from lower chamber 586) via the sealing engagement formed between: intermediate seal 520 of inner mandrel 502 against the inner surface 542 of carrier ring 540, inner seal 576 of energizing ring 570 against the outer surface 508 of inner mandrel 502, and the outer seal 582 of ring 570 and the inner surface 542 of carrier ring 540. Lower chamber 586 is in fluid communication with second actuation passage 534 of inner mandrel 502 but is otherwise sealed off from the surrounding environment (including from upper chamber 584) via the sealing engagement formed between: the inner seal 576 of energizing ring 570 against the outer surface 508 of inner mandrel 502, the intermediate seal 523 of inner mandrel 502 against the inner surface of lower retainer ring 565, and the seal 566 of ring 565 against the inner surface 572 of energizing ring 570.

As will be discussed further herein, energizing ring 570 includes a first or upper position (shown in FIG. 13) relative inner mandrel 502, carrier ring 540, and lower retainer ring 565, and a second or lower position relative mandrel 502 and rings 540, 565, that is axially spaced from the upper position. In the upper position, lower end 570B of energizing ring 570 is disposed directly adjacent or contacts an angled or conical profile 560C (shown in FIG. 18) disposed on the outer surface of running tool lock ring 560, and when in the lower position, the conical profile 560C of running tool lock ring 560 is disposed directly adjacent or contacts lower shoulder 580 of energizing ring 570. First and second actuation passages 532 and 534 of inner mandrel 502 are configured to actuate or displace energizing ring 570 between the upper and lower positions via selectively pressurizing and venting upper and lower chambers 584 and 586, respectively. Particularly, pressurization of upper chamber 584 applies a pressure force against the upper end 570A of energizing ring 570 to displace ring 570 towards the shoulder 558 of carrier ring 540 while pressurization of lower chamber 586 applies a pressure force against the upper shoulder 578 of energizing ring 570 to actuate or axially displace ring 570 upwards towards intermediate annular shoulder 522 of inner mandrel 502.

The inner sleeve 590 of running tool 500 is generally cylindrical and is in sliding engagement with the outer surface 508 of inner mandrel 502. In the embodiment shown in FIG. 13, inner sleeve 590 includes a first or upper end 590A, a second or lower end 590B, a central bore or passage defined by a generally cylindrical inner surface 592 extending between ends 590A and 590B, and a generally cylindrical outer surface 594 extending between ends 590A and 590B. The inner surface 592 of inner sleeve 590 includes an annular shoulder 596 facing lower end 590B, while the outer surface 594 of sleeve 590 includes an annular shoulder 598 facing upper end 590A, where shoulder 596 is disposed below (i.e., towards lower end 590B) shoulder 598. Additionally, outer surface 594 of inner sleeve 590 includes an anti-rotation key 600 extending radially outwards therefrom, where key 600 is axially located between shoulders 596 and 598.

In the embodiment shown in FIG. 13, inner sleeve 590 also includes a control line passage 602 that extends axially between shoulders 596 and 598. In the configuration shown in FIG. 13, the portion of inner surface 592 axially extending between upper end 590A and shoulder 596 of inner sleeve 590 is in sliding engagement with the outer surface 508 of inner mandrel 502, with intermediate seal 516 sealing against the inner surface 592 of sleeve 590. Additionally, at least a portion of the segment of inner surface 592 extending between shoulder 596 and lower end 590B is in sliding engagement with the outer surface 544 of carrier ring 540.

The outer sleeve 610 of running tool 500 is generally cylindrical and is in sliding engagement with an outer surface of upper retainer ring 630 and the outer surface 594 of inner sleeve 590. In the embodiment shown in FIG. 13, outer sleeve 610 includes a first or upper end 610A, a second or lower end 610B, a central bore or passage defined by a generally cylindrical inner surface 612 extending between ends 610A and 610B, and a generally cylindrical outer surface 614 extending between ends 610A and 610B. The inner surface 612 of outer sleeve 610 includes a first or upper annular shoulder 616 facing upper end 610A, an annular seal 618 disposed therein, and a second or lower annular shoulder 620 facing lower end 610B, where seal 618 is axially located between shoulders 616 and 618 and is configured to seal against the outer surface 594 of inner sleeve 590.

In the embodiment shown in FIG. 13, outer sleeve 610 additionally includes an elongate anti-rotation slot 622 extending between surfaces 612 and 614, and a control line passage 624 that extends axially between shoulders 616 and 618 of inner surface 612. Slot 622 of outer sleeve 610 is configured to receive the anti-rotation key 600 of inner sleeve 590. When anti-rotation key 600 of inner sleeve 590 is received in slot 622 of outer sleeve 610, a delimited amount of relative axial movement is permitted between inner sleeve 590 and outer sleeve 610, while relative rotation is restricted therebetween. The restriction of relative rotation between sleeves 590 and 610 provided by the insertion of anti-rotation key 600 in anti-rotation slot 622 allows for the control line passage 624 of outer sleeve 610 to maintain circumferential alignment with the control line passage 602 of inner sleeve 590. In the embodiment shown in FIG. 13, an alignment pin 626 extends radially between and through carrier ring 540, inner sleeve 590, and outer sleeve 610 to maintain the axial alignment between ring 540 and sleeves 590, 610, prior to coupling of the running tool 500 with the control line assembly 450 and hanger 430 (pin 626 is removed just prior to coupling tool 500 with assembly 450 and hanger 430); however, in other embodiments, running tool 500 may not include alignment pin 626.

The upper retainer ring 630 of running tool 500 is generally cylindrical and includes a first or upper end 630A, a second or lower end 630B, a central bore or passage defined by a generally cylindrical inner surface 632 extending between ends 630A and 630B, and a generally cylindrical outer surface 634 extending between ends 630A and 630B. In the embodiment shown in FIG. 13, the inner surface 632 of upper retainer ring 630 includes a releasable or threaded connector configured to releasably couple with the upper connector 512 of inner mandrel 502, while the outer surface 634 of ring 630 includes an annular seal 636 disposed therein and configured to seal against the portion of the inner surface 612 of outer sleeve 610 extending between upper end 610A and upper shoulder 616. Additionally, the upper seal 514 of inner mandrel 502 seals against the inner surface 632 of upper retainer ring 630.

In the embodiment shown in FIG. 13, upper retainer ring 630 includes a control line passage 638 extending between ends 630A and 630B that is circumferentially aligned with the control line passage 624 of outer sleeve 610. Further, upper retainer ring 630 also includes a control or actuation passage 640 circumferentially spaced from control line passage 638 and extending between ends 630A and 630B, where an upper terminal end of actuation passage 640 receives a control line connector 536 configured to couple with a control line (not shown).

The penetrator 650 of running tool 500 is generally cylindrical and includes a first or upper end 650A and a second or lower end 650B, a central bore or passage 652 defined by a generally cylindrical inner surface extending between ends 650A and 650B, and a generally cylindrical outer surface 654 extending between ends 650A and 650B. In the embodiment shown in FIG. 13, the outer surface 654 of penetrator 650 includes a first or upper annular seal 656 disposed therein and axially located proximal upper end 650A, and a second or lower annular seal 658 disposed therein and axially located proximal lower end 650B. In the arrangement shown in FIG. 13, upper end 650A of penetrator 650 is received in the control line passage 638 of upper retainer ring 630 with upper seal 656 sealing against an inner surface of passage 638, while the lower end 650B of penetrator 650 is received in control line passage 624 of outer sleeve 610 with lower seal 658 sealing against an inner surface of passage 624. Thus, penetrator 650 is configured to provide a sealed connection between control line passage 638 of upper retainer ring 630 and the control line passage 624 of outer sleeve 610 while also permitting relative axial movement between ring 630 and sleeve 610.

In the configuration shown in FIG. 13, an annular chamber 660 is formed between the lower end 630B of upper retainer ring 630 and the upper shoulder 616 of outer sleeve 610. Chamber 660 is in fluid communication with actuation passage 640 of upper retainer ring 630 but is otherwise sealed off from the surrounding environment by the sealing engagement formed between: the upper seal 514 of inner mandrel 502 and the inner surface 632 of upper retainer ring 630, the seal 636 of ring 630 and the inner surface 612 of outer sleeve 610, the intermediate seal 516 of inner mandrel 502 and the inner surface 592 of inner sleeve 590, the seal 618 of outer sleeve 610 and the outer surface 594 of inner sleeve 590, and the sealed connection formed by seals 656 and 658 of penetrator 650 discussed above. In this arrangement, actuation passage 640 of upper retainer ring 630 is configured to selectively pressurize chamber 660 and thereby actuate or axially displace outer sleeve 610 and inner sleeve 590 relative inner mandrel 502 via the application of fluid pressure against upper shoulder 616 of sleeve 610 and upper end 590A of sleeve 590.

Figure 14:
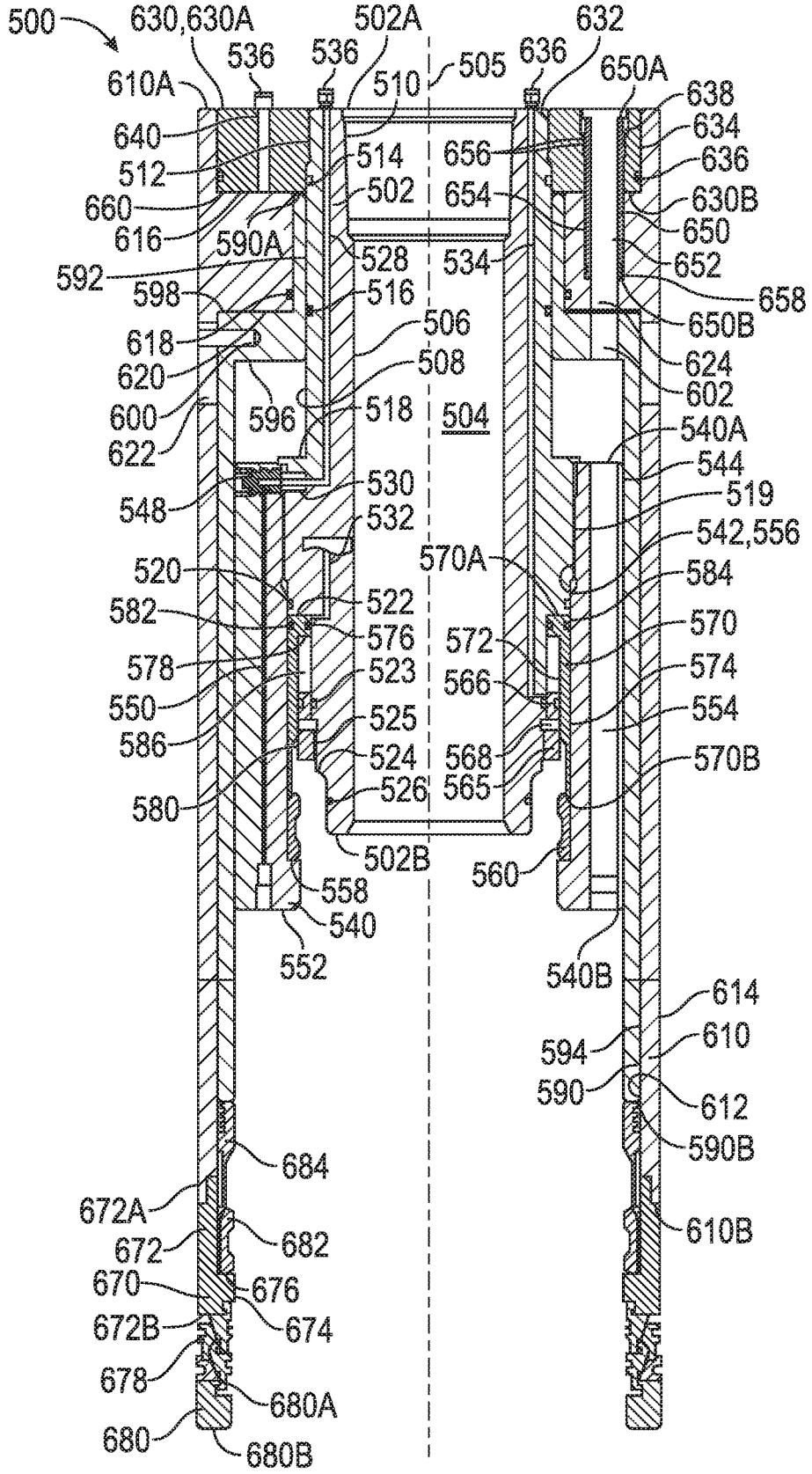
FIG. 14 is a cross-sectional view of an embodiment of a wellhead assembly of the well system of FIG. 1 shown in a first position in accordance with principles disclosed herein.

Referring to FIGS. 1, 12-14, an embodiment of an annular seal assembly 670 of the wellhead assembly of FIG. 1 is shown in FIG. 14 along with running tool 500. Seal assembly 670 is generally configured to seal the annular interface formed between the outer surface 156 of hanger 430 and an inner surface of wellhead housing 102' when hanger 430 is landed therein. In the embodiment shown in FIG. 14, seal assembly 670 generally includes a carrier ring 672, a plurality of annular seals 678, a first or lower actuation or energizing ring 680, an annular seal engagement or lock ring 682, and a second or upper actuation or energizing ring 684. Carrier ring 672 is releasably coupled to the lower end 610B of the outer sleeve 610 of running tool 500 and has a first or upper end 672A and a second or lower end 672B coupled with seals 678. Carrier ring 672 also includes a central bore or passage defined by a generally cylindrical inner surface 674 extending between ends 672A and 672B, where inner surface 674 includes an annular shoulder 676 facing upper end 672A. Shoulder 676 receives the seal lock ring 682 which is disposed directly adjacent or contacts shoulder 676. Upper energizing ring 684 includes a first or upper end disposed directly adjacent lower end 590B of inner sleeve 590 and a second or lower end disposed directly adjacent an angled or conical profile on the outer surface of seal lock ring 682 disposed proximal the upper end of seal lock ring 682. In the embodiment shown in FIG. 14, lower energizing ring 680 includes a first or upper end 680A coupled with seals 678 and a second or lower end 680B.

Figure 15:
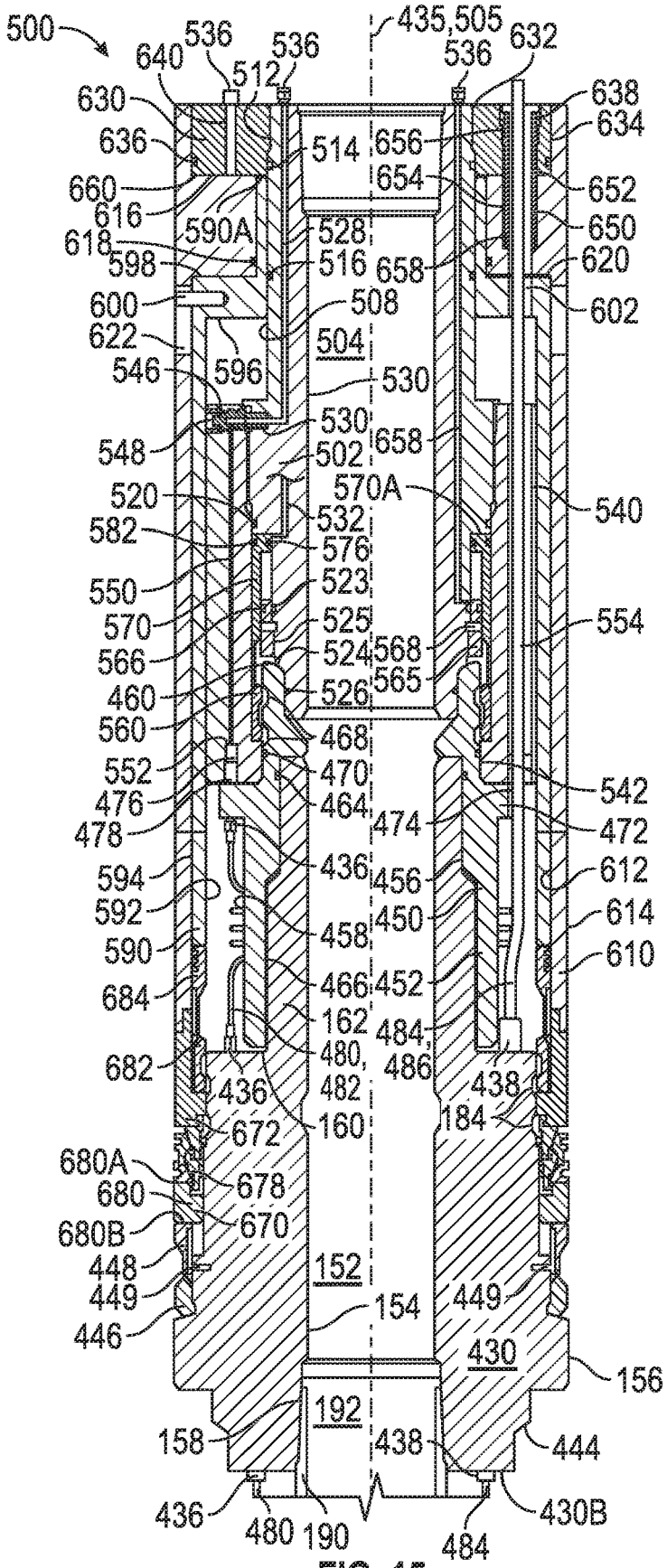
FIG. 15 is a cross-sectional view of the wellhead assembly of FIG. 14 shown in a second position.
Figure 16:
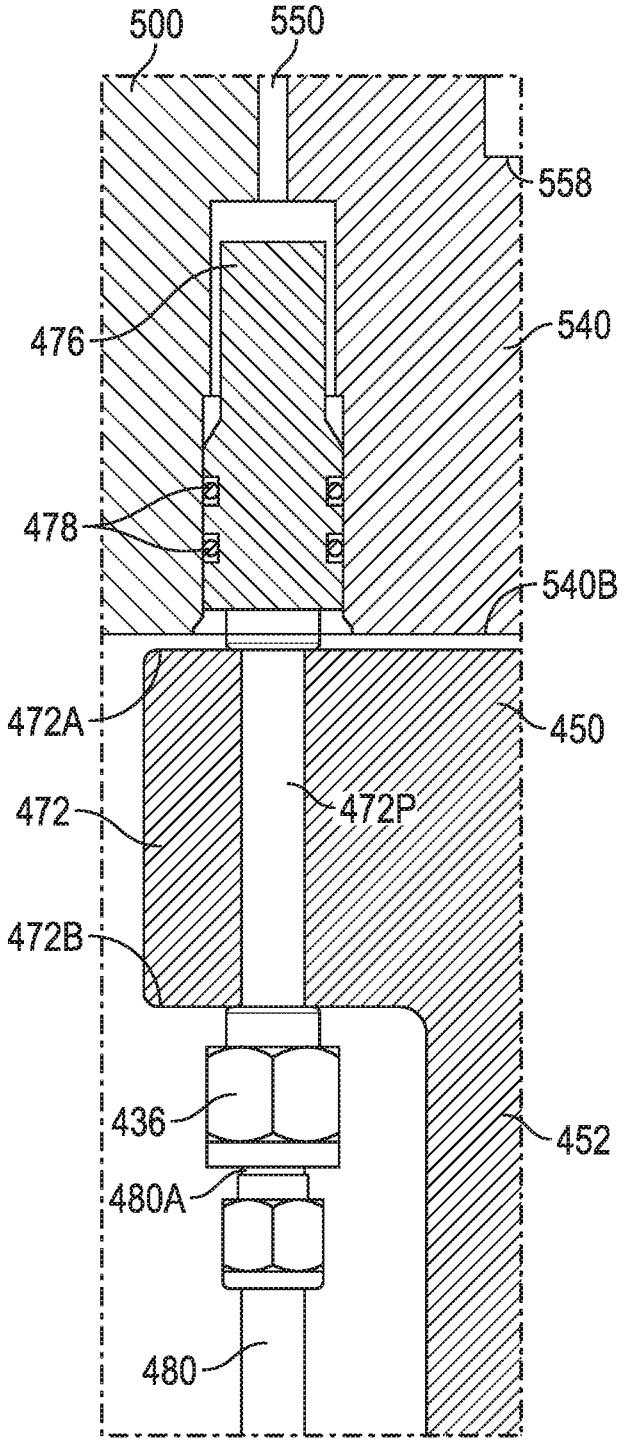
FIG. 16 is a zoomed-in view of the wellhead assembly of FIG. 14 as shown in the second position of FIG. 15.

Referring to FIGS. 12, 13, 15, and 16, control line assembly 450 and hanger 430 are shown stabbed into running tool 500 in FIGS. 15 and 16. For clarity, control line passages 432, 434, and 222P are hidden in FIGS. 15, 17, 19, 20, 21, 23, and 24. After control line mandrel 452 and first control lines 480 are coupled with hanger 430 and seal assembly 670 is coupled with running tool 500, hanger 430 and control line assembly 450 are stabbed into running tool 500. As hanger 430 and control line assembly 450 are stabbed into tool 500, the landing shoulder 460 of control line mandrel 452 lands against lower shoulder 524 of the inner mandrel 502 of running tool 500, axially locating assembly 450 and hanger 430 relative tool 500. Additionally, as assembly 450 and hanger 430 are stabbed into tool 500 the stab connector 476 of assembly 450 is stabbed into the lower receptacle 552 of carrier ring 540, as shown particularly in FIG. 16, with seals 478 of connector 476 sealing against an inner surface of lower receptacle 552 to provide a sealed connection between lower receptacle 552 and the control line passage 472P of control line mandrel 452.

With control line assembly 450 and hanger 430 stabbed into running tool 500, the lower end 680B of the lower energizing ring 680 of seal assembly 670 is disposed directly adjacent or seats against the upper end of hanger energizing ring 448. Additionally, in the position shown in FIGS. 15 and 16, seal 470 of control line mandrel 452 seals against the inner surface 542 of carrier ring 540 and running tool lock ring 560 of carrier ring 540 aligns axially with locking grooves 468 of mandrel 452. Additionally, lower seal 526 of inner mandrel 502 seals against the inner surface 456 of control line mandrel 452, providing a sealed fluid flowpath extending between the bore 504 of inner mandrel 502 and the bore 152 of hanger 430. Running tool lock ring 560 is disposed in the unlocked position, and thus, relative axial movement between running tool 500 and control line assembly 450 (as well as hanger 430 coupled with mandrel 450) is not restricted in the position shown in FIG. 15. Following the stabbing of control line mandrel 452 and hanger 430 into running tool 500, second control line 484 may be stabbed upwards through: second control line passage 434 (not shown in FIG. 15) of hanger 430, second control line passage 554 of carrier ring 540 (second control line 484 is received in pocket 474 of control line mandrel 452 to allow line 484 to pass into passage 554 with minimum bending to line 484), control line passage 602 of inner sleeve 590, and through bore 652 of penetrator 650. In this arrangement, second control line 484 extends continuously through hanger 430 and running tool 500, providing a continuous signal pathway 486 (not shown in FIG. 15) extending between a signal source above running tool 500 and a signal destination at or below hanger 430, such as a controllable tool or valve suspended from hanger 430. With hanger 430 stabbed into running tool 500 as shown in FIGS. 15 and 16, the central axis 435 of hanger 430 is disposed substantially coaxial with central axis 505 of running tool 500.

Figure 17:
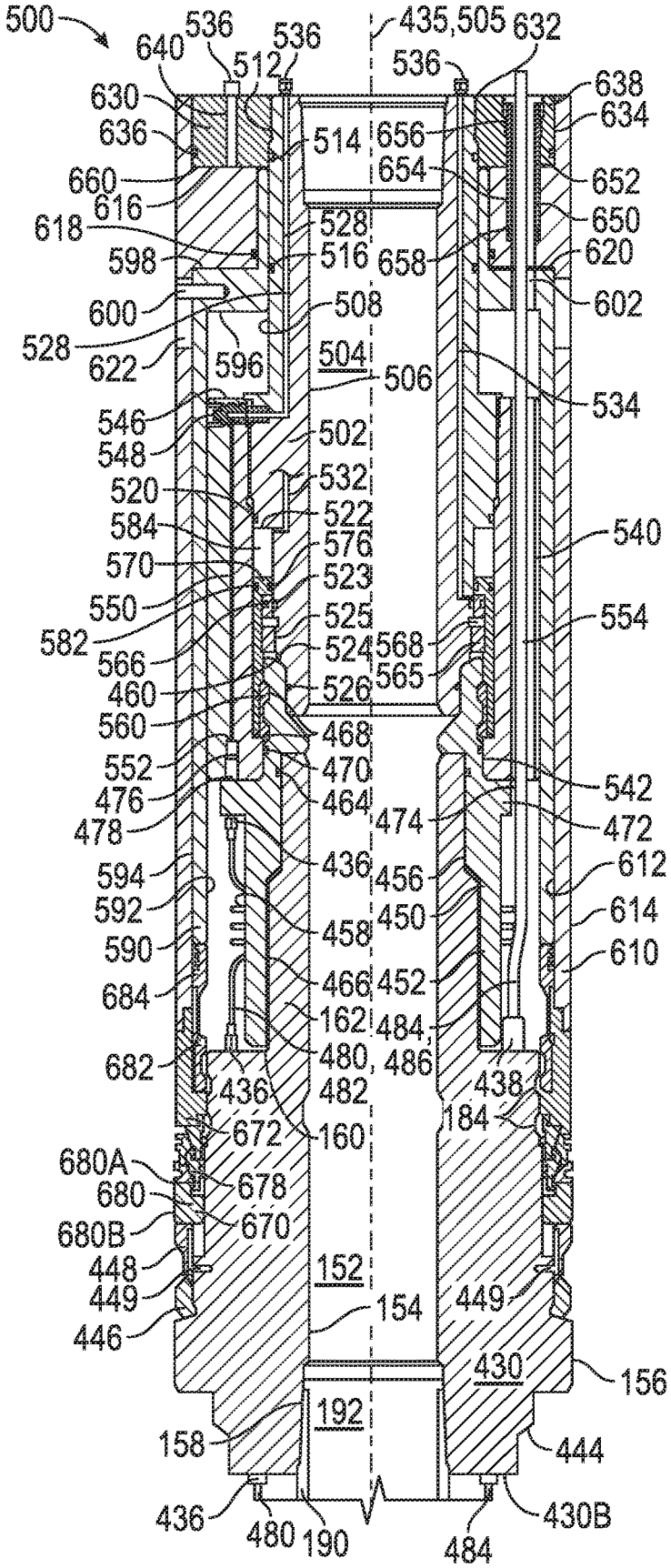
FIG. 17 is a cross-sectional view of the wellhead assembly of FIG. 14 shown in a third position.
Figure 18:
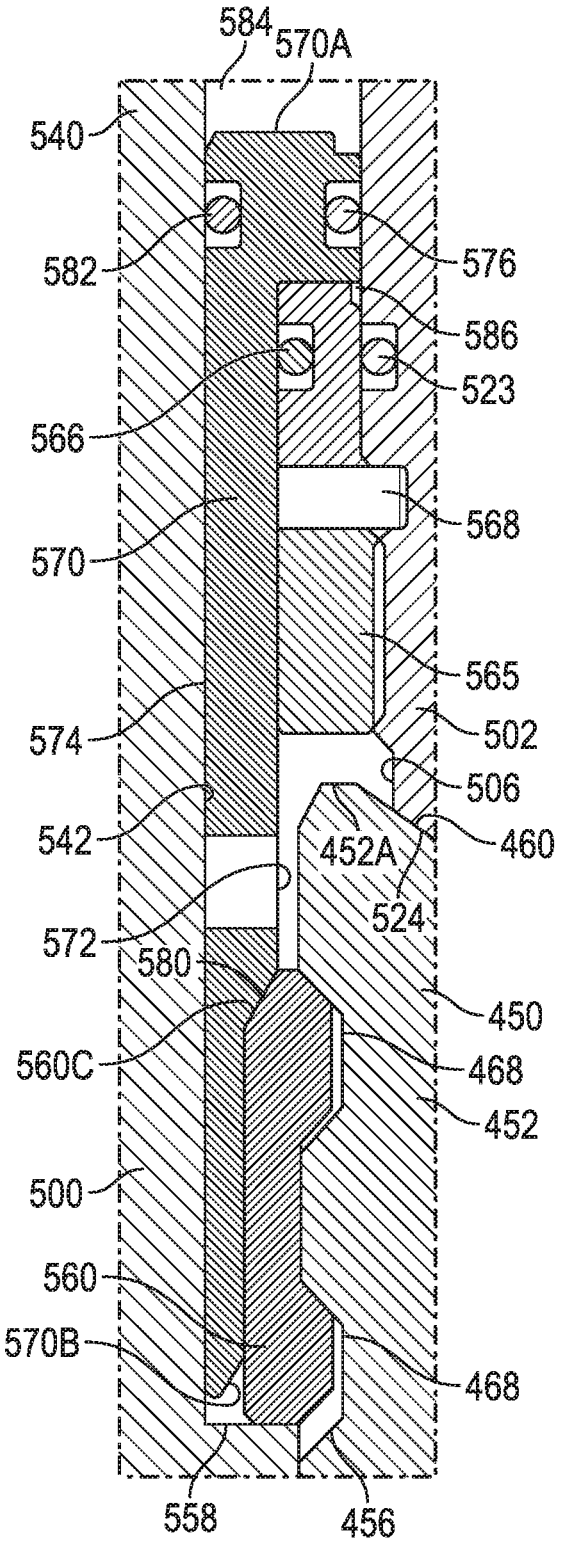
FIG. 18 is a zoomed-in view of the wellhead assembly of FIG. 14 as shown in the third position of FIG. 17.

Referring to FIGS. 12,1 3, 17, and 18, following the insertion of control line assembly 450 (including second control line 484) and hanger 430 into running tool 500, assembly 450 and hanger 430 may be releasably locked to running tool 500, as shown in FIGS. 17 and 18. Particularly, to lock control line assembly 450/hanger 430 with running tool 500, the upper chamber 584 formed between inner mandrel 502 and energizing ring 570 is pressurized via first actuation passage 532 of mandrel 502 while the lower chamber 586 formed between energizing ring 570 and lower retainer ring 565 is allowed to vent via second actuation passage 534 of mandrel 502. The pressurization of upper chamber 584 and venting of lower chamber 586 applies a net pressure force against energizing ring 570 in the downwards direction (i.e., towards shoulder 558 of carrier ring 540), which displaces or actuates energizing ring from the upper position (shown in FIG. 15) to the lower position shown in FIG. 17.

As energizing ring 570 shifts into the lower position, engagement between the lower end 570B of ring 570 and the conical profile 560C of running tool lock ring 560 forces running tool lock ring 560 into the locked position received in the locking grooves 468 of inner mandrel 452, which locks or restricts relative axial movement between inner mandrel 452 of control line assembly 450 and the inner mandrel 502 of running tool 500. Additionally, engagement between lower shoulder 580 of energizing ring 570 and the conical profile 560C of running tool lock ring 560 when ring 570 is in the lower position retains running tool lock ring 560 in the locked position. The locking engagement between inner mandrel 502 of running tool 500 and the control line mandrel 452 of control line assembly 450 allows running tool 500 to physically support or suspend hanger 430 from tool 500.

Figure 19:
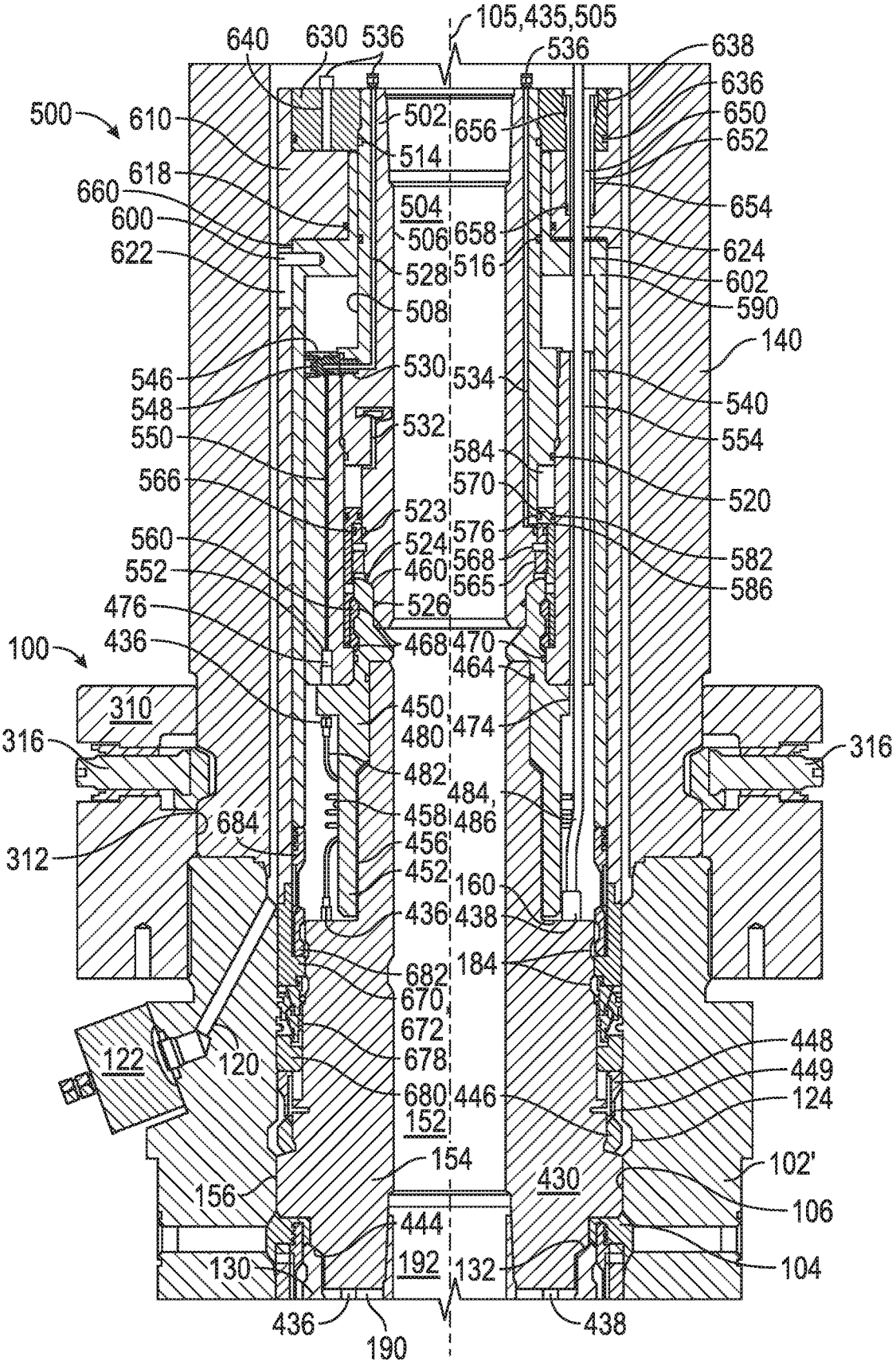
FIG. 19 is a cross-sectional view of the wellhead assembly of FIG. 14 shown in a fourth position.

Referring to FIGS. 1, 12, 13, and 19, with hanger 430 supported by running tool 500, hanger 430 may be run into a central bore or passage 104 of the wellhead housing 102' of wellhead assembly 100 using running tool 500, as shown in FIG. 19. Particularly, in the embodiment shown in FIG. 19, wellhead housing 102' includes a control line passage 120 extending between inner surface 106 and a connector or valve 122 coupled to the outer surface of wellhead housing 102'. Further, the central axis 105 of wellhead housing 102' is disposed substantially coaxial with central axes 435 and 505 of hanger 105 and running tool 500, respectively, when hanger 430 is landed within wellhead housing 102'.

In the embodiment shown in FIG. 19, an annular landing or support member 130 is positioned in the bore 104 of wellhead housing 102', where landing member 130 includes an angled or conical landing profile 132 at an upper end thereof. Landing member 130 is configured to axially locate and physically support hanger 430 upon the landing of hanger 430 within wellhead housing 102'. In some embodiments, landing member 130 may comprise a tubing or casing hanger, a bowl, or other tubular component landed in wellhead housing 102' prior to the running of hanger 430 into housing 102'. In other embodiments, wellhead housing 102' may not include landing member 130, and instead, hanger 430 may land directly against a landing profile formed in the inner surface 106 of wellhead housing 102'. In the embodiment shown in FIG. 19, a drilling riser 140 extends from an upper end of wellhead housing 102' and is secured or coupled with wellhead housing 102' via annular connector 310 disposed about the upper end of housing 102' and a lower end of drilling riser 140. However, in other embodiments, wellhead housing 102' may couple with other components than drilling riser 140.

As shown in FIG. 19, hanger 430 is lowered downwards through bore 104 of wellhead housing 102' by running tool 500 (conveyed by a conveyance string or other device not shown in FIG. 19) until the lower shoulder 444 of hanger 430 lands against or contacts the landing profile 132 of landing member 130, which ceases the downward displacement of hanger 430 and axially locates hanger 430 within bore 104 of wellhead housing 102'. In the landed position of hanger 430 shown in FIG. 19, hanger lock ring 446 is axially aligned with a locking groove 124 of wellhead housing 102', with hanger lock ring 446 disposed in a radially inner unlocked position spaced from locking groove 124. Thus, in the position shown in FIG. 19, hanger 430 is not axially locked to wellhead housing 102'.

Figure 20:
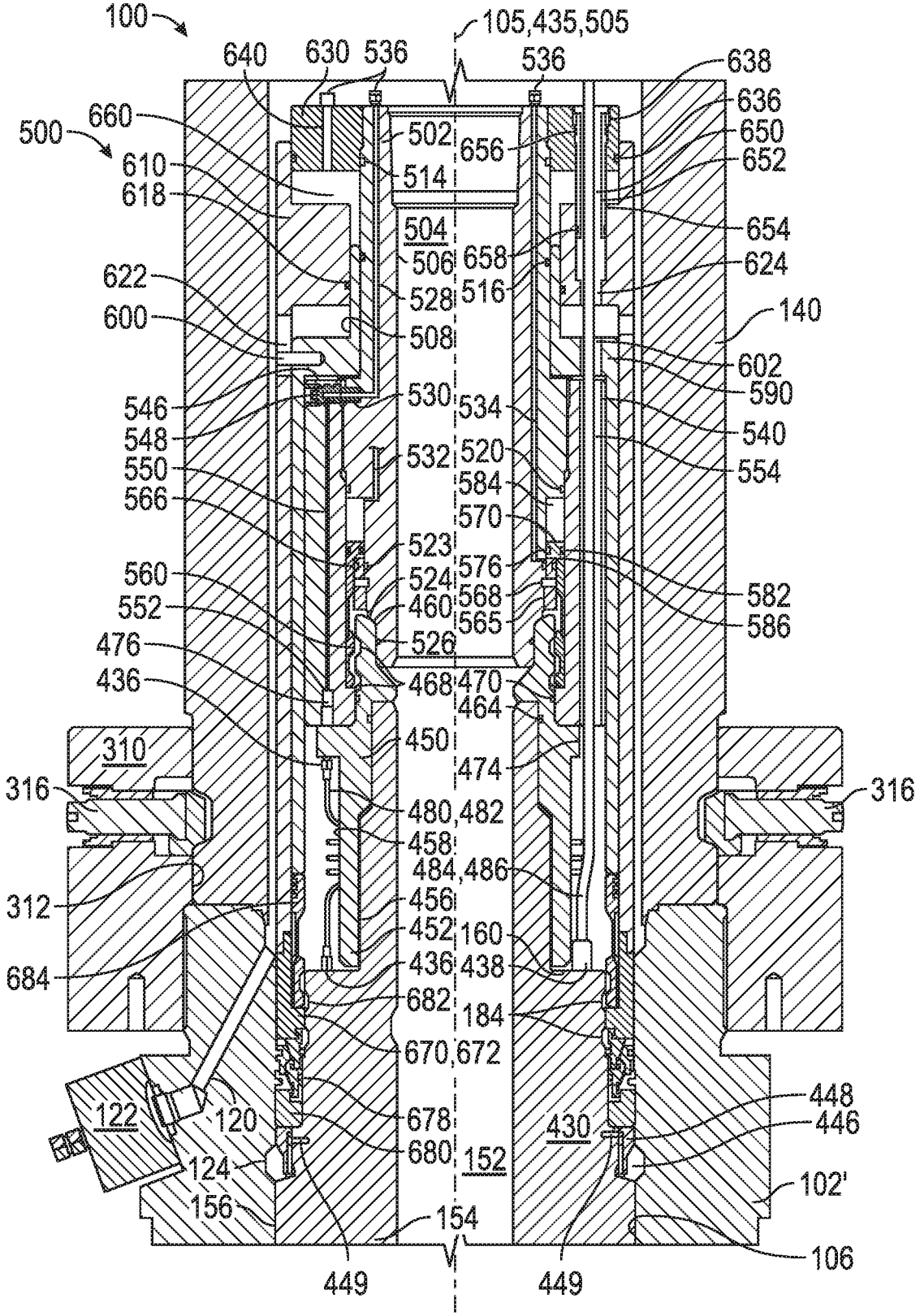
FIG. 20 is a cross-sectional view of the wellhead assembly of FIG. 14 shown in a fifth position.

Referring to FIGS. 1, 12, 13, 19, and 20, following the landing of hanger 430 within wellhead housing 102' as shown in FIG. 19, hanger 430 may be coupled or axially locked to wellhead housing 102' to restrict relative axial movement between wellhead housing 102' and hanger 430, as shown in FIG. 20. Additionally, following the landing of hanger 430 within wellhead housing 102', the plurality of seals 678 of seal assembly 670 may be actuated or energized to seal against the inner surface 106 of wellhead housing 102' and the outer surface 156 of hanger 430, and locked into an energized position via seal lock ring 682, as shown in FIG. 20.

Particularly, with hanger 430 landed in wellhead housing 102', annular chamber 660 of running tool 500 may be pressurized via the actuation passage 640 of upper retainer ring 630 to apply an axially downwards directed (i.e., towards bore 104 of wellhead housing 102') pressure force against upper shoulder 616 of outer sleeve 610 and the upper end 590A of inner sleeve 590. The pressure force applied to outer sleeve 610 and inner sleeve 590 actuates or displaces both outer sleeve 610 and inner sleeve 590 axially downwards towards bore 104 of wellhead housing 102'. Downwards displacement of outer sleeve 610 forces seal assembly 670 axially downwards, which in-turn forces hanger energizing ring 448 axially downwards via engagement from the lower end 680B of lower energizing ring 680, shearing the shear pins 449 coupling hanger energizing ring 448 with hanger 430. Further, the downwards displacement of hanger energizing ring 448 actuates or displaces hanger lock ring 446 into a radially outwards locked position via engagement between an angled or conical interface disposed therebetween. In the locked position shown in FIG. 20, hanger lock ring 446 is received in the locking groove 124 of wellhead housing 102', restricting relative axial movement between hanger 430 and wellhead housing 102'.

Additionally, downwards displacement of outer sleeve 610 energizes the annular seals 678 of seal assembly 670 by compressing the seals 678 between the lower end 672B of upper energizing ring 672 and the upper end 680A of lower energizing ring 680, forcing seals 678 into sealing engagement with both the inner surface 106 of wellhead housing 102' and the outer surface 156 of hanger 430. Further, the downwards displacement of inner sleeve 590 acts to retain or lock seals 678 into the energized position by forcing upper energizing ring 684 downwards against seal lock ring 682, which thereby actuates or displaces seal lock ring 682 into a radially inner locked position (ring 682 is shown in a radially outer unlocked position in FIG. 19) via an angled or conical interface formed therebetween. When seal lock ring 682 is disposed in the locked position, lock ring 682 is received in the locking grooves 184 of hanger 430, restricting relative axial movement between seal assembly 670 (including annular seals 678) and hanger 430.

As described above, running tool 500 is configured to install both control lines 480, 484, and hanger 430 in wellhead housing 102' in a single run (i.e., a single displacement or conveyance of a running or installation tool to wellhead assembly 100), thereby decreasing the complexity and total time required for installing control lines 480, 484, and hanger 430 in the wellhead housing 102' of wellhead assembly 100 relative other running tools that would require multiple runs to perform the same or a similar operation. Additionally, running tool 500 is configured to install control lines 480, 484, and hanger 430 in the wellhead housing 102' of wellhead assembly 100 without rotating either running tool 500, control line assembly 450, hanger 430, or seal assembly 670. In other words, running tool 500 is configured to install control lines 480, 484, and hanger 430 in the wellhead housing 102' of wellhead assembly 100 via axially directed forces provided by, and movements of, components of running tool 500. In this manner, running tool 500 may install control lines 480, 484, and hanger 430 in wellhead housing 102' without tangling control lines 480 and 484 from rotation of running tool 500.

Figure 21:
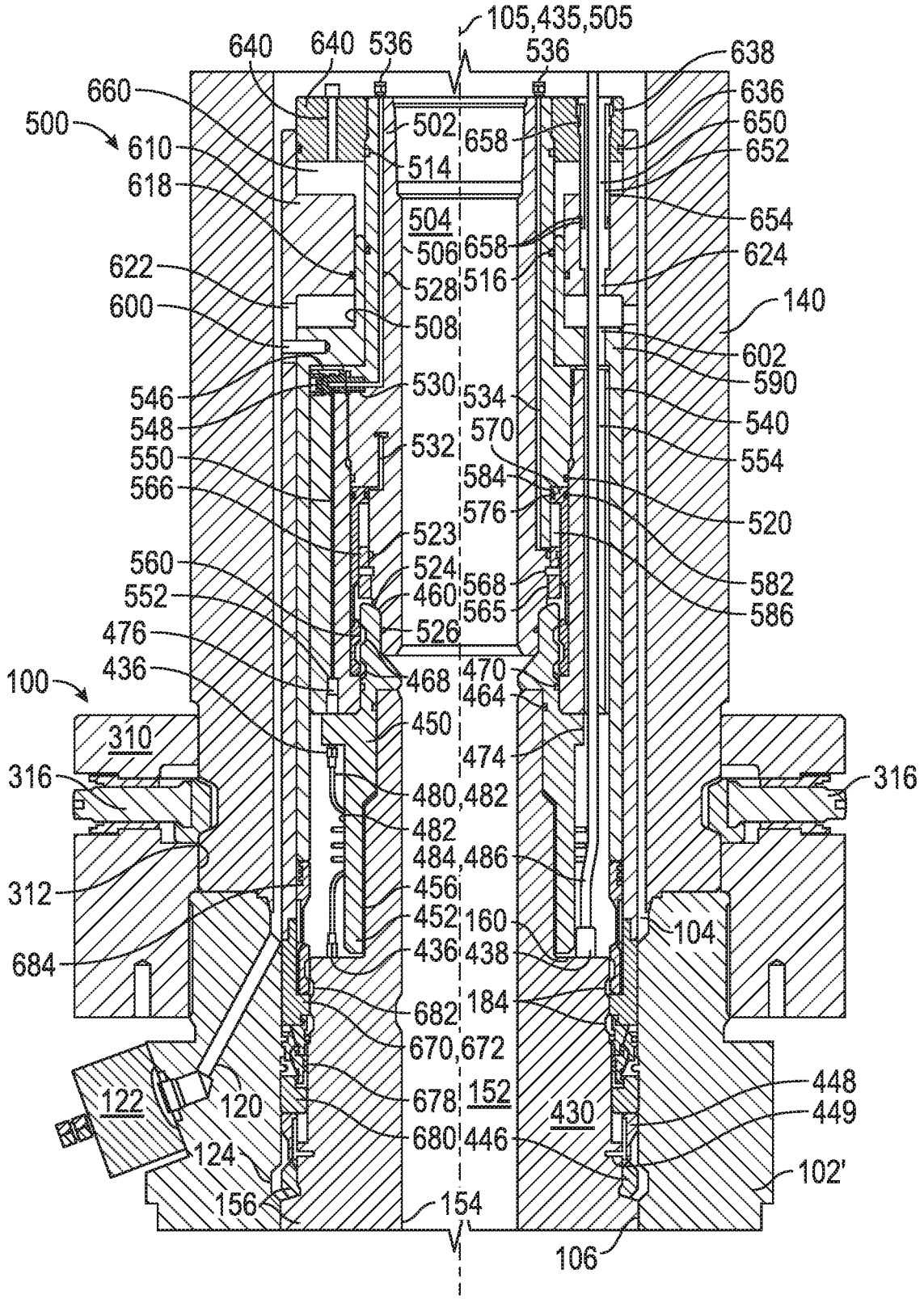
FIG. 21 is a cross-sectional view of the wellhead assembly of FIG. 14 shown in a sixth position.
Figure 22:
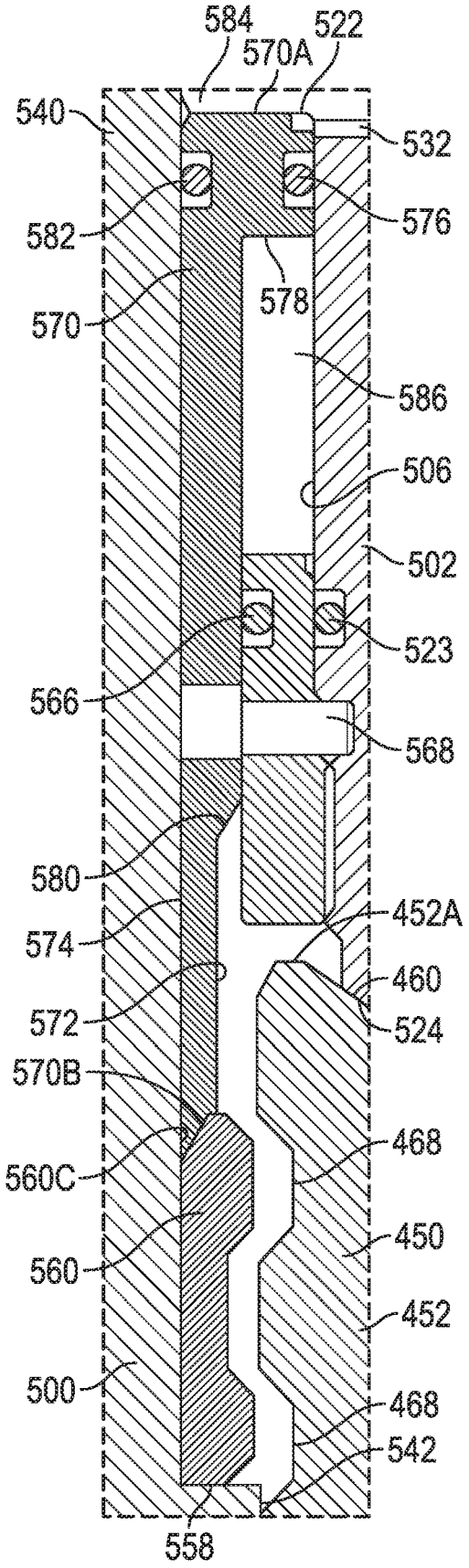
FIG. 22 is a zoomed-in view of the wellhead assembly of FIG. 14 as shown in the sixth position of FIG. 21.
Figure 23:
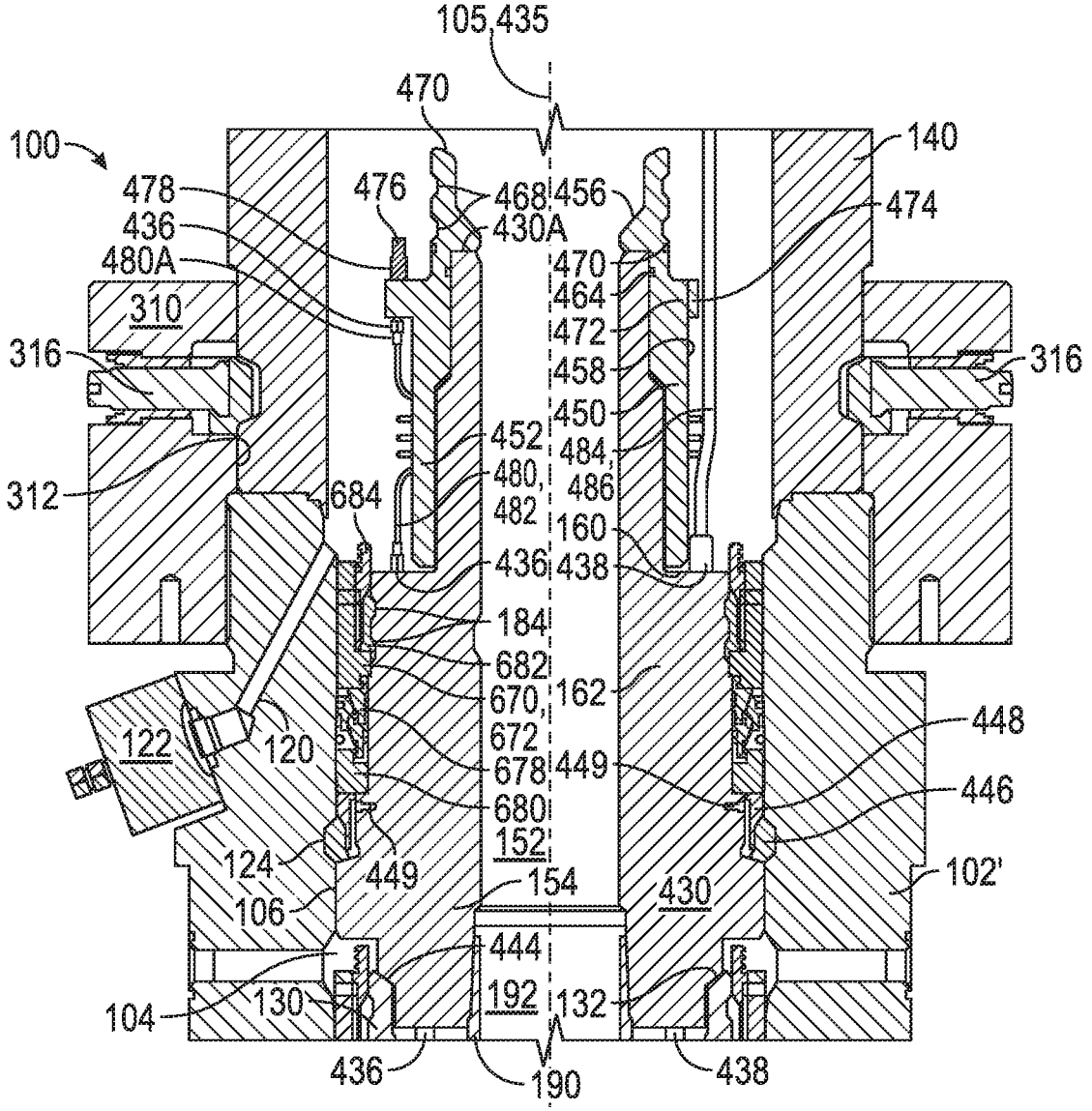
FIG. 23 is a cross-sectional view of the wellhead assembly of FIG. 14 shown in a sixth position.

Referring to FIGS. 1, 12, 13, and 21-23, following the locking of hanger 430 in wellhead housing 102' and the energization and locking of annular seals 678, running tool 500 may be unlocked from hanger 430 (shown in FIGS. 21 and 22) and removed from wellhead assembly 100 (shown in FIG. 23). Particularly, to unlock hanger 430 from running tool 500, lower chamber 586 is pressurized via second actuation passage 534 while upper chamber 584 is allowed to vent via first actuation passage 532. The pressurization of lower chamber 586 and venting of upper chamber 584 applies a net pressure force against energizing ring 570 in the upwards direction (i.e., away from shoulder 558 of carrier ring 540), which displaces or actuates energizing ring from the lower position (shown in FIG. 20) to the upper position shown in FIGS. 21 and 22.

With energizing ring 570 displaced into the upper position, running tool lock ring 560 is permitted to actuate or be displaced from the radially inner locked position to the radially outer unlocked position where ring 560 is spaced from the locking grooves 468 of control line mandrel 452, thereby permitting relative axial movement between inner mandrel 502 of running tool 500 and hanger 430. In some embodiments, running tool lock ring 560 is biased radially outwards such that ring 560 automatically actuates into the unlocked position upon displacement of energizing ring 570 into the upper position, while in other embodiments, running tool lock ring 560 may remain in the locked position until a sufficient upwards force is applied to inner mandrel 502 (e.g., from a conveyance string or other tool supporting the suspended running tool 500) to force running tool lock ring 560 into the unlocked position with energizing ring 570 no longer in position to maintain lock ring 560 in the locked position.

Following the unlocking of running tool 500 from hanger 430 as shown in FIGS. 21 and 22, running tool 500 may be retracted from the wellhead housing 102' of wellhead assembly 100 via the conveyance string or other tool from which running tool 500 is suspended, leaving running tool assembly 450 and hanger 430 disposed in wellhead housing 102', as shown in FIG. 23. As running tool 500 is removed from hanger 430 and control line assembly 450, stab connector 476 of control line assembly 450 is removed from the lower receptacle 552 of carrier ring 540, thereby breaking the first signal pathway 482 such that control signals may no longer be communicated along first signal pathway 482 between the signal source and the signal destination.

Conversely, given that second control line 484 is continuous between the signal source and signal destination of second signal pathway 486, second signal pathway 486 remains unbroken during the process of removing running tool 500 from the hanger 430 and wellhead 102' of wellhead assembly 100, allowing for the continuous transmission of control signals between the source and destination of pathway 486 during this process. Particularly, as running tool 500 is removed from wellhead assembly 100, the stationary second control line 484 is permitted to slide through: second control line passage 554 of carrier ring 540, control line passage 602 of inner sleeve 590, and through bore 652 of penetrator 650. In this manner, running tool 500 is permitted to be moved axially or retracted from wellhead assembly 100 while the connection formed by second signal pathway 486 of second control line 484 is maintained. Thus, if it becomes desirable or necessary to actuate a downhole tool, such as a shut-off valve disposed in wellbore 8 in response to a leak or other incident occurring therein, while running tool 500 is being retracted from wellhead assembly 100, a control signal may be communicated to actuate said shut-off valve via the second signal pathway 486 provided by second control line 484.

Figure 24:
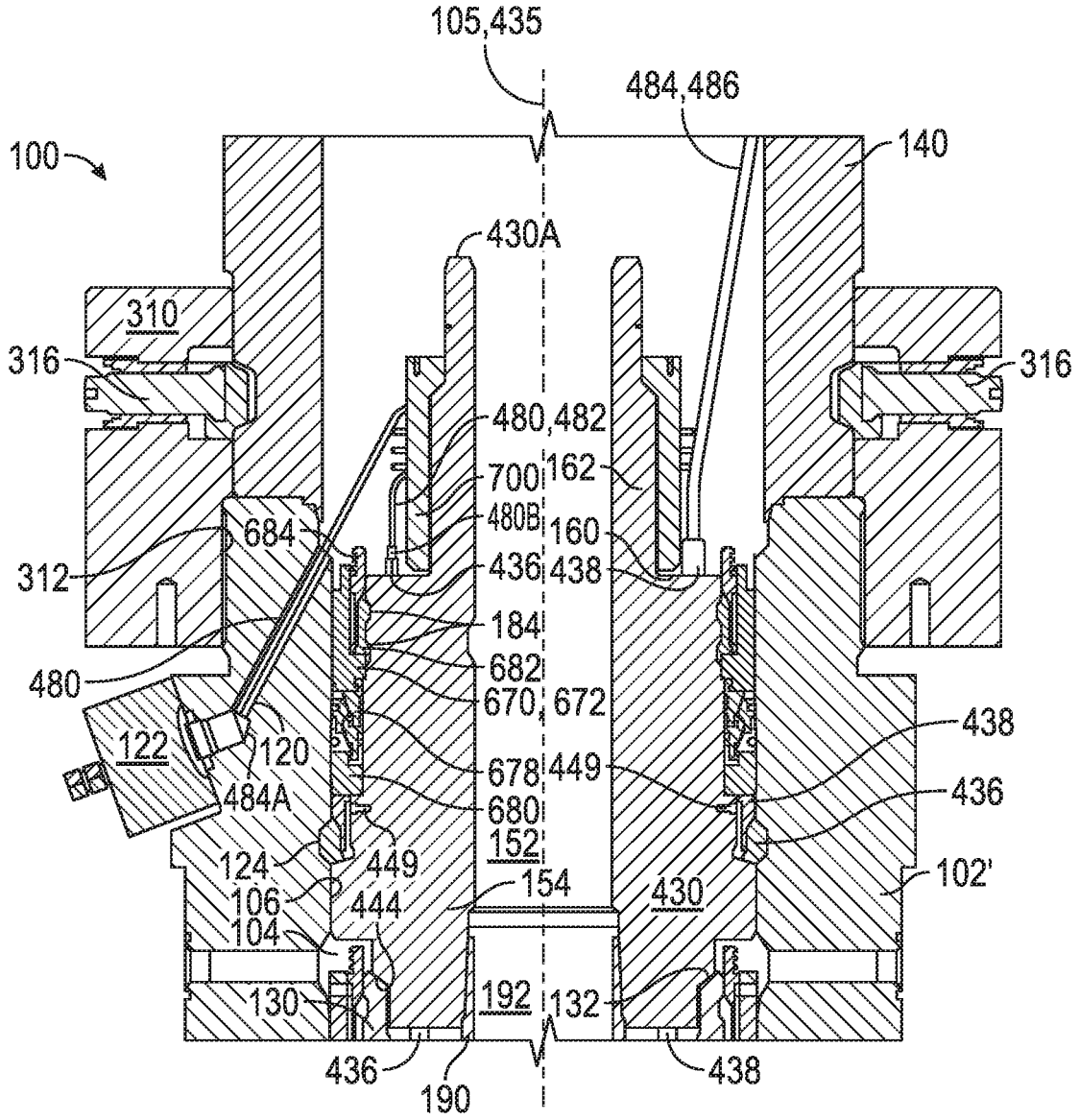
FIG. 24 is a cross-sectional view of the wellhead assembly of FIG. 14 shown in a sixth position.

Referring to FIGS. 1, 12, 13 and 24, after running tool 500 has been successfully retracted from wellhead assembly 100, the installation of hanger 430 in the wellhead housing 102' of wellhead assembly 100 may be completed by reestablishing the first signal pathway 482 provided by first control lines 480, as shown in FIG. 24. Particularly, the upper first control line 480 is disconnected from the control line fitting 436 of control line mandrel 452 and the control line mandrel 452 is removed or decoupled from the neck 162 of hanger 430. In the embodiment shown in FIG. 24, an annular support ring 700 is releasably coupled to the neck 162 of hanger 430, where support ring 700 is configured to support a seal assembly (not shown) for sealing against other components of wellhead assembly 100; however, in other embodiments, wellhead assembly 100 may not include support ring 700. The upper first control line 480 may then be wrapped about support ring 700 and inserted through control line passage 120 of wellhead housing 102' such that control line 480 may be coupled with valve 122 of housing 102'. With upper first control line 480 coupled with valve 122, the first signal pathway 482 of first control line 480 may be reestablished to permit communication of control signals between the signal source and signal destination of first signal pathway 482. In some embodiments, either before or after first signal pathway 482 is reestablished, second control line 484 may be cut and terminated or connected to a connector coupled to wellhead housing 102' (e.g., similar to the arrangement of valve 122 and upper first control line 480) or another component of wellhead assembly 100. By terminating control lines 480 and 484 at the wellhead assembly 100, the signal source for signal pathways 482 and 486, respectively, may be provided directly at the wellhead assembly 100 via a connector coupled thereto, such as valve 122 in the embodiment shown in FIG. 24.

Figure 25:
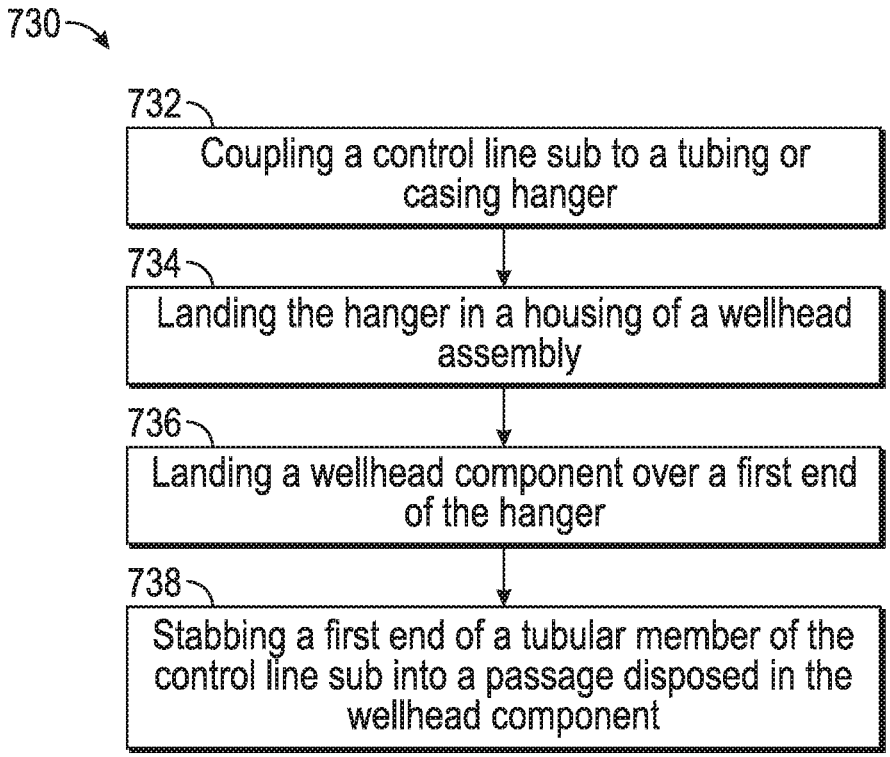
FIG. 25 is a flowchart illustrating an embodiment of a method for installing a tubing or casing hanger in a wellhead assembly in accordance with principles disclosed herein.

Referring to FIG. 25, an embodiment of a method 730 for installing a tubing or casing hanger in a wellhead assembly is shown in FIG. 25. At block 732 of method 730, a control line sub or assembly is coupled to a tubing or casing hanger. In the embodiment of FIG. 25, the control line sub comprises a tubular member having a first end and a second end that is received in a first receptacle of the tubing or casing hanger. In some embodiments, block 732 comprises coupling support ring 202 and stab connectors 220 to the hanger 150, as shown in FIGS. 2, 6, and 7. In some embodiments, block 732 comprises coupling torque rings 382 and control lines 400 to hanger 360, as shown in FIG. 11. At block 734 of method 730, the tubing or casing hanger is landed in a housing of the wellhead assembly. In certain embodiments, block 734 comprises landing hanger 150 in the central bore 104 of wellhead housing 102, as shown in FIG. 5. In certain embodiments, block 734 comprises landing hanger 360 in the central bore 104 of wellhead housing 102, as shown in FIG. 11.

At block 736 of method 730, a wellhead component is landed over a first end of the tubing or casing hanger. In certain embodiments, block 736 comprises landing the lower end 320A of seal flange adapter 320 against the upper end 102A of wellhead housing 102, as shown in FIGS. 8 and 11. At block 738 of method 730, the first end of the tubular member of the control line sub is stabbed into a passage disposed in the wellhead component. In some embodiments, block 738 comprises stabbing the upper ends 220A of stab connectors 220 into the control line passages 338 of seal flange adapter 320, as shown in FIG. 8. In some embodiments, block 738 comprises stabbing the upper ends 400A of control lines 400 into the control line passages 338 of seal flange adapter 320, as shown in FIG. 11.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A control line assembly for coupling with a tubing or casing hanger of a wellhead assembly, comprising:

a support ring configured to couple with the tubing or casing hanger, wherein the support ring is configured to be disposed at least partially between the tubing or casing hanger and a wellhead component of the wellhead assembly; and a tubular member configured to extend through a first bore disposed in the support ring, wherein the tubular member is configured to extend between the tubing or casing hanger and the wellhead component, a first end of the tubular member is configured to be stabbed into a passage disposed in the wellhead component, and a second end of the tubular member is configured to be stabbed into a first receptacle disposed in the tubing or casing hanger;

wherein, when the control line assembly is coupled with the tubing or casing hanger and the wellhead component is landed over the tubing or casing hanger, a passage disposed in the tubular member is configured to provide communication between the passage of the wellhead component and the first receptacle of the tubing or casing hanger;

wherein the support ring is configured to be lowered over a neck of the tubing or casing hanger and comprises a plurality of circumferentially spaced first bores configured to receive a plurality of the tubular members;

the support ring comprises a plurality of circumferentially spaced second bores configured to receive a plurality of fasteners; and the tubing or casing hanger comprises a plurality of circumferentially spaced first receptacles configured to receive the plurality of tubular members and a plurality of circumferentially spaced second receptacles configured to receive and releasably couple with the fasteners.

2. The control line assembly of claim 1, further comprising:

a plurality of first seal assemblies configured to be received in the first receptacles of the tubing or casing hanger;

wherein each of the first seal assemblies comprises an annular outer seal and an annular inner seal and a frustoconical interface disposed between the outer seal and the inner seal;

wherein each of the tubular members comprises a flange including an annular shoulder configured to apply a compressive force to one of the first seal assemblies when the control line assembly is coupled with the tubing or casing hanger and the wellhead component is landed over the tubing or casing hanger.

3. The control line assembly of claim 2, further comprising:

a guide ring configured to be lowered over the tubing or casing hanger when the control line assembly is coupled with the tubing or casing hanger and the wellhead component is landed over the tubing or casing hanger;

wherein the guide ring comprises a first end, a second end, and a plurality of circumferentially spaced bores extending between the first and second ends and configured to receive the plurality of tubular members.

4. The control line assembly of claim 3, wherein:

the guide ring comprises a plurality of circumferentially spaced apertures extending into the first end of the guide ring, wherein the apertures are aligned with the bores of the guide ring;

the control line assembly further comprises a plurality of spacer rings configured to be received in the receptacles of the guide ring;

the control line assembly comprises a plurality of second seal assemblies configured to be disposed about the tubular members and landed against the spacer rings, wherein each of the second seal assemblies comprises an annular outer seal and an annular inner seal and a frustoconical interface disposed between the outer seal and the inner seal; and wherein the second seal assemblies are configured to be received in a plurality of receptacles extending into the wellhead component and aligned with a plurality of passages disposed in the wellhead component to seal a connection formed between the passages of the wellhead component and the passages of the tubular members when the control line assembly is coupled with the tubing or casing hanger and the wellhead component is landed over the tubing or casing hanger.

5. The control line assembly of claim 1, wherein an outer surface of the tubular member comprises an annular seal configured to sealingly engage an inner surface of the passage of the wellhead component when the control line assembly is coupled with the tubing or casing hanger and the wellhead component is landed over the tubing or casing hanger.

6. A control line assembly for coupling with a tubing or casing hanger of a wellhead assembly, comprising:

a support ring configured to couple with the tubing or casing hanger, wherein the support ring is configured to be disposed at least partially between the tubing or casing hanger and a wellhead component of the wellhead assembly; and a tubular member configured to extend through a first bore disposed in the support ring, wherein the tubular member is configured to extend between the tubing or casing hanger and the wellhead component, a first end of the tubular member is configured to be stabbed into a passage disposed in the wellhead component, and a second end of the tubular member is configured to be stabbed into a first receptacle disposed in the tubing or casing hanger;

wherein, when the control line assembly is coupled with the tubing or casing hanger and the wellhead component is landed over the tubing or casing hanger, a passage disposed in the tubular member is configured to provide communication between the passage of the wellhead component and the first receptacle of the tubing or casing hanger and the control line assembly further comprising:

a plurality of the support rings, wherein each support ring is configured to be received in one of a plurality of first receptacles of the tubing or casing hanger; and a plurality of first seal assemblies configured to be received in the plurality of first receptacles of the tubing or casing hanger;

wherein, the support rings are configured to apply a compressive force to the first seal assemblies in response to the application of torque to the support rings.

7. The control line assembly of claim 6, wherein an outer surface of each support ring comprises male threads configured to releasably couple with female threads disposed on an inner surface of each first receptacle of the tubing or casing hanger.

8. A method for installing a tubing or casing hanger in a wellhead assembly, comprising:

coupling a control line assembly to the tubing or casing hanger, wherein the control line assembly comprises a support ring and a tubular member having a first end and a second end, wherein the second end is received in a first receptacle of the tubing or casing hanger, the tubular member extends through a first bore disposed in the support ring, and the support ring couples to the tubing or casing hanger to support the tubular member;

landing the tubing or casing hanger in a housing of the wellhead assembly;

landing a wellhead component over a first end of the tubing or casing hanger; and stabbing the first end of the tubular member into a passage disposed in the wellhead component, wherein the tubular member extends between the tubing or casing hanger and the wellhead component, and the support ring is disposed at least partially between the tubing or casing hanger and the wellhead component.

9. The method of claim 8, further comprising:

coupling the tubing or casing hanger with a running tool; and stabbing the first end of the tubular member into a passage disposed in the running tool to provide communication between the passage of the running tool and the first receptacle of the tubing or casing hanger.

10. The method of claim 8, further comprising applying a torque to the support ring to thread the support ring into the first receptacle and to compress a seal assembly disposed between an annular shoulder of the tubular member and an annular shoulder of the first receptacle of the tubing or casing hanger.

11. The method of claim 8, further comprising:

disposing a plurality of fasteners in a plurality of circumferentially spaced second bores disposed in the support ring of the control line assembly; and coupling the plurality of fasteners to a plurality of circumferentially spaced second apertures extending into the tubing or casing hanger to couple the control line assembly with the tubing or casing hanger.

12. The method of claim 11, comprising:

disposing each tubular member of a plurality of tubular members through a respective first bore of a plurality of circumferentially spaced first bores in the support ring, wherein the plurality of tubular members includes the tubular member, and the plurality of circumferentially spaced first bores includes the first bore;

receiving the second end of each tubular member of the plurality of tubular members in a respective first receptacle of a plurality of circumferentially spaced first receptacles in the tubing or casing hanger, wherein the plurality of circumferentially spaced first receptacles includes the first receptacle; and stabbing the first end of each tubular member of the plurality of tubular members into a respective passage of a plurality of circumferentially spaced passages disposed in the wellhead component, wherein the plurality of circumferentially spaced passages includes the passage.

13. The method of claim 8, comprising:

disposing a guide ring between the tubing or casing hanger and the wellhead component; and disposing the tubular member through the guide ring, wherein tubular member extends from opposite ends of the guide ring to the first and second ends, and the guide ring is disposed between the tubing or casing hanger and the wellhead component.

14. The method of claim 13, comprising:

disposing each tubular member of a plurality of tubular members through a respective first bore of a plurality of circumferentially spaced first bores in the support ring or a plurality of support rings including the support ring, wherein the plurality of tubular members includes the tubular member, and the plurality of circumferentially spaced first bores includes the first bore;

disposing each tubular member of the plurality of tubular members through a respective second bore of a plurality of circumferentially spaced second bores in the guide ring;

receiving the second end of each tubular member of the plurality of tubular members in a respective first receptacle of a plurality of circumferentially spaced first receptacles in the tubing or casing hanger, wherein the plurality of circumferentially spaced first receptacles includes the first receptacle; and stabbing the first end of each tubular member of the plurality of tubular members into a respective passage of a plurality of circumferentially spaced passages disposed in the wellhead component, wherein the plurality of circumferentially spaced passages includes the passage.

15. A system, comprising:

a control line assembly, comprising:

one or more support rings comprising a plurality of first bores;

a guide ring comprising a plurality of second bores; and a plurality of tubular members extending through the plurality of first bores and the plurality of second bores, wherein the one or more support rings, the guide ring, and the plurality of tubular members are disposed between a hanger and a wellhead component of a wellhead assembly, wherein the plurality of tubular members extend into a plurality of receptacles in the hanger and extend into a plurality of passages in the wellhead component;

wherein the plurality of first bores is disposed in a single support ring of the one or more support rings and a plurality of threaded fasteners extending through a plurality of third bores in the single support ring are configured to couple the single support ring to the hanger.

16. The system of claim 15, wherein each of the plurality of first bores is disposed in a different support ring of the one or more support rings, and each different support ring is configured to thread into a threaded portion of one of the plurality of receptacles in the hanger.

17. The system of claim 15, comprising the hanger, the wellhead component, or a combination thereof.

* * * * *